US006212339B1

(12) United States Patent
Inoue et al.

(10) Patent No.: US 6,212,339 B1
(45) Date of Patent: Apr. 3, 2001

(54) IMAGE FORMING APPARATUS WITH DISCHARGING EXPOSURE AFTER SHUTDOWN

(75) Inventors: Katsushi Inoue, Nara; Mitsuhiro Hasegawa, Suita; Keizo Kitamura; Tomoko Mamemoto, both of Yamatokoriyama, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/528,300

(22) Filed: Mar. 17, 2000

(30) Foreign Application Priority Data

Mar. 17, 1999 (JP) ..... 11-072567

(51) Int. Cl.[7] ..... L03G 21/08
(52) U.S. Cl. ..... 399/18; 399/128
(58) Field of Search ..... 399/18, 51, 127, 399/128, 129

(56) References Cited

U.S. PATENT DOCUMENTS 3,851,966 * 12/1974 Reehil et al. ..... 399/18
5,459,555 10/1995 Yamasa et al. .
5,598,252 1/1997 Yamasa et al. .
5,881,334 * 3/1999 Maruts et al. ..... 399/18

FOREIGN PATENT DOCUMENTS 1-63990 * 3/1989 (JP) .
1-109374 * 4/1989 (JP) .
5-045958 2/1993 (JP) .
9-080870 3/1997 (JP) .
2000-3114 * 1/2000 (JP) .

* cited by examiner

*Primary Examiner*—Joan Pendegrass

(57) ABSTRACT

An image forming apparatus includes (i) a photosensitive drum for holding an electrostatic latent image on its surface, the photosensitive drum being driven to rotate by a motor, (ii) charging means for charging the surface of the photosensitive drum so that the surface has a predetermined polarity and a predetermined potential, (iii) exposing means for forming an electrostatic latent image by exposing the charged surface of the photosensitive drum, and (iv) developing means for developing the electrostatic latent image, and is arranged so that after stop of the motor due to occurrence of a trouble, during an inertial rotation time in which the photosensitive drum rotates due to an inertial force, the exposing means executes discharge exposure with respect to a charge remaining region on the surface of the photosensitive drum.

11 Claims, 13 Drawing Sheets

IMAGE FORMING APPARATUS WITH DISCHARGING EXPOSURE AFTER SHUTDOWN

FIELD OF THE INVENTION

The present invention relates to an image forming apparatus adopting a photoelectronic technique for forming images, characters, etc. on a transfer material, and particularly relates to an image forming apparatus capable of obviating damage to a photosensitive body upon occurrence of a trouble.

BACKGROUND OF THE INVENTION

An image forming apparatus adopting a conventional photoelectronic technique is designed so that, as shown in FIG. 14, a charger 102, an exposing device 103, a developing device 104, a transfer charger 105, a cleaning device 106, and a discharger lamp 107 are provided around a photosensitive drum 101 disposed at center.

In such an image forming apparatus, the photosensitive drum 101 is first charged to a predetermined potential and a predetermined polarity by the charger 102 (charging step), then a surface of the photosensitive drum 101 is exposed by a laser light or the like projected thereto by the exposing device 103. Here, the surface of the photosensitive drum 101 comes to have areas which are exposed thereby undergoing lowering of potentials, and areas which are not exposed thereby not undergoing lowering of potentials. With such potential differences in areas, an electrostatic latent image is formed on the surface of the photosensitive drum 101 (exposing step).

The electrostatic latent image, developed by the developing device 104, becomes a toner image (developing step). The toner image is transferred by the transfer charger 105 onto a transfer material (paper) 110 supplied from a paper feed section, not shown (transferring step).

Thereafter, the transfer material 110 on which the toner image has been transferred is subjected to a fixing step conducted by a fixing section, now shown, and discharged to outside the apparatus.

On the other hand, toner remaining on a surface of the photosensitive drum 101 after the transferring step is removed from the surface of the photosensitive drum 101 by the cleaning device 106 (cleaning step). Further, remaining charges on the surface of the photosensitive drum 101 are removed by the discharger lamp 107 (discharging step), and the operation immediately shifts to the next image forming step.

The removal of remaining charges in the photosensitive drum 101 by the discharger lamp 107, conducted after completion of the transferring step, is an indispensable step. Without this discharging step, uniformness of a charged state is degraded, and this causes exposure memory, or a phenomenon of lowering of surface potentials at only specific portions.

Particularly, in the case where a charger of a contact type is used as the charger 102, a discharging step is not conducted while recharging by the charger 102 is repeatedly carried out, thereby causing the potential of the photosensitive drum 101 to rise. In some cases, this may cause insulation breakdown of the photosensitive drum 101. In the case where a charger of a non-contact type such as scorotron is used as the charger 102, it much less likely causes insulation breakdown of the photosensitive drum 101, but the surface potential of the photosensitive drum 101 gradually rises as the recharging is repeatedly carried out, and this is not desirable for the photosensitive drum 101.

Provision of discharging means to be used exclusively for discharge, such as the discharging lamp 107, however, hinders efforts for further reduction of the size and costs of the image forming apparatus. Therefore, techniques for discharge without discharging means used exclusively for discharging has conventionally been developed.

The Japanese Publication for Laid-Open Patent Application No. 3883/1994 (Tokukaihei 6-3883 [Publication Date: Jan. 14, 1994]) discloses a technique (technique ① in which after a part of a photosensitive drum is discharged by a laser light emitted from an exposing device, a laser light with a normal image forming exposure power is further projected thereon so that a potential on the photosensitive drum is lowered.

In this technique, after a normal image forming step, a voltage is once applied to a main charger to raise the surface potential of the photosensitive drum, then, the surface of the photosensitive drum is reversely charged by a transfer charger so that the surface potential becomes low, and thereafter, a development bias voltage is turned off. After this turning-off of the development bias voltage, a laser light is projected from an exposing device while its power is controlled, and a laser light with a normal image forming exposure power for image exposure is projected thereon so that the surface potential of the photosensitive drum is lowered to such a potential that no fog occurs (about 100V to 300V as a potential difference between the potential of the photosensitive drum and the development bias voltage). Thus the photosensitive drum surface is electrically cleaned.

Furthermore, the Japanese Publication for Laid-Open Patent Application No. 80870/1997 (Tokukaihei 9-80870 [Issue Date: Mar. 28, 1997]) discloses a technique (technique ②) in which a discharging operation is started in response to a detection signal of detecting means.

In this technique, in an image forming apparatus using a contact-type charger, after an AC voltage applied to a charging member is turned off upon completion of the image forming operation, a transfer material discharge sensor as detecting means detects a front edge or a rear edge of a transfer material and outputs a detection signal for discharge of the photosensitive drum before power-off of the apparatus. Based on the detection signal, an AC voltage is applied to the charging member again, and memory of the photosensitive drum is removed.

In this technique, particularly, it is implied that lamp-use exposing means for uniformly exposing the photosensitive drum can be used in the place of the charging means.

The foregoing techniques ① and ② provide only schemes applicable during normal operations, and do not provide measures to cope with irregular events. For example, in the case where a trouble during an image forming operation interrupts the image forming process before the discharge of the photosensitive drum is completed, the photosensitive drum is consequently left having a high surface potential. Therefore, this causes the following problem to arise: during an attempt to correct the trouble until finally the next image forming operation starts, the apparatus is left in a state in which toner adhesion or carrier adhesion tends to occur.

Furthermore, in the discharging step, irrespective of cases, the case where the discharge lamp 107 is used, or the case where light used for writing such as laser emitted by the exposing device 103 is used without provision of the discharge lamp 107, the surface potential of the photosensitive drum 101 is made to sharply drop either by keeping the discharge lamp 107 turned on always or by projecting light always. Therefore, a problem arises in that the photosensitive drum 101 is excessively exposed, thereby causing the operational efficiency of the apparatus to lower.

SUMMARY OF THE INVENTION

An object of the present invention is to provide an image forming apparatus superior in the operational efficiency, by arranging the same so that toner adhesion or carrier adhesion to a photosensitive drum, which tends to be caused upon occurrence of a trouble except an operational trouble of an exposure-use light source or upon restarting after such a trouble is corrected, is avoided for preventing damage to the photosensitive drum and ensuring safety of the photosensitive drum.

To achieve the foregoing object, the image forming apparatus of the present invention is characterized by comprising (i) a photosensitive drum for holding an electrostatic latent image on its surface, the photosensitive drum being driven to rotate by a motor, (ii) charging means for charging the surface of the photosensitive drum so that the surface has a predetermined polarity and a predetermined potential, (iii) exposing means for forming an electrostatic latent image by exposing the charged surface of the photosensitive drum, and (iv) developing means for developing the electrostatic latent image, and the apparatus is arranged so that, after stop of the motor due to occurrence of a trouble, during an inertial rotation time in which the photosensitive drum rotates due to an inertial force, the exposing means executes discharge exposure with respect to a charge remaining region on the surface of the photosensitive drum.

With the foregoing arrangement, the photosensitive drum is discharged by the exposing means exposing the same during the inertial rotation time. Therefore, remaining charges are surely removed without provision of an independent discharging means, thereby resulting in sure prevention of adhesion of toner and carrier to the surface of the photosensitive drum. Consequently, excessive accumulation of charges and damage to the photosensitive drum are avoided, and therefore, safety is enhanced.

Moreover, since the photosensitive drum is discharged during the time of inertial rotation of the photosensitive drum, it is possible to immediately shift to the next image forming operation upon restarting after a trouble is corrected. This makes it unnecessary to prepare an extra period of time for discharge after correction of the trouble, thereby remarkably improve the operational efficiency of the apparatus.

For a fuller understanding of the nature and advantages of the invention, reference should be made to the ensuing detailed description taken in conjunction with the accompanying drawings.

BRIEF DESCRIPTION OF THE DRAWINGS

FIG. 8(*b*) is an explanatory view schematically illustrating a rotation angle of the photosensitive drum in a decelerating rotation state.

FIG. 9(*b*) is a graph showing angular velocity-rotation time relationship in the case where the discharge exposure finishes during an inertial rotation of the photosensitive drum shown in FIG. 2.

FIG. 9(*c*) is a graph showing angular velocity-rotation time relationship during the steady rotation of the photosensitive drum shown in FIG. 2.

FIG. 10(*b*) is a timing chart showing an example of operations of a charger, an exposing device, and the photosensitive drum in the case where the discharge exposure does not finish during an inertial rotation of the photosensitive drum shown in FIG. 2.

FIG. 11(*b*) is a timing chart showing another example of operations of a charger, an exposing device, and the photosensitive drum in the case where the discharge exposure does not finish during an inertial rotation of the photosensitive drum shown in FIG. 2.

DESCRIPTION OF THE PREFERRED EMBODIMENTS

First Embodiment

The following description will explain an embodiment of the present invention while referring to FIGS. 1 through 6. The present invention, however, is not limited to this embodiment.

An image forming apparatus in accordance with the present invention is arranged so that, in the case where an operation of the apparatus is suspended due to occurrence of a trouble and charges remain on a surface of a photosensitive drum, the photosensitive drum is exposed by exposing means during an inertial rotation time in which the photosensitive drum inertially rotates, so that the remaining charges are removed therefrom.

Figure 2:
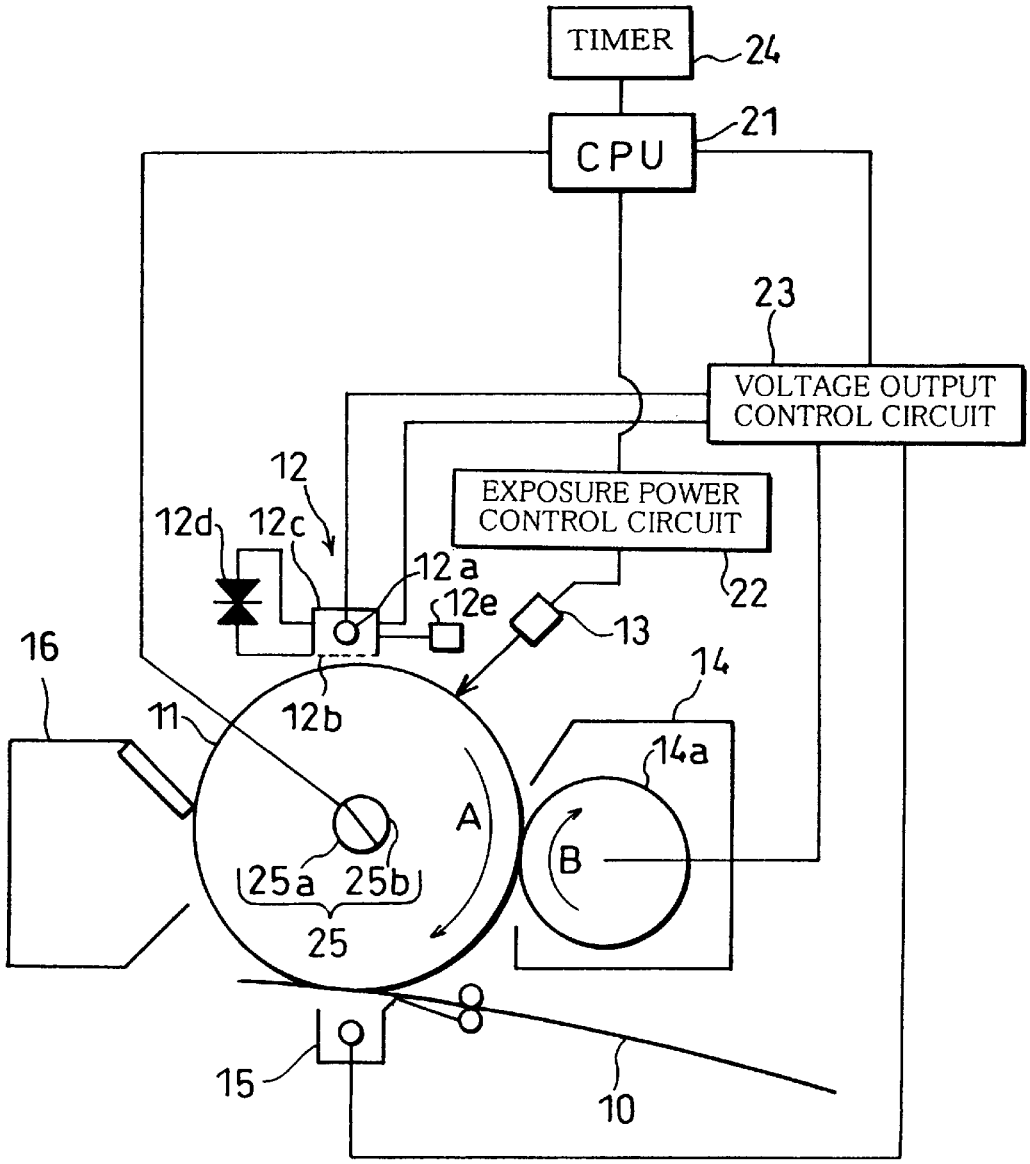
FIG. 2 is a view schematically illustrating an arrangement of an image forming apparatus subjected to the control operation shown in FIG. 1.

As shown in FIG. 2, the image forming apparatus of the present invention includes a photosensitive drum 11, a charger (charging means) 12, an exposing device (exposing means) 13, a developer (developing means) 14, a transfer charger (transfer means) 15, a cleaning device (cleaning means) 16, a CPU (control means) 21, an exposure power control circuit 22, a voltage output control circuit 23, a timer 24, detecting means (inertial rotation state checking means) 25, a motor control device, not shown, etc. The charger 12, the exposing device 13, the developer 14, the transfer charger 15, the cleaning device 16, and the like are disposed around the photosensitive drum 11.

The photosensitive drum 11 is to hold an electrostatic latent image formed by the exposing device 13 after the photosensitive drum 11 is charged to a predetermined potential by the charger 12. The photosensitive drum 11 rotates so that its surface moves from the charger 12 side to the developer 14 side (in an arrow A direction shown in FIG. 2), and the rotation is controlled by a motor and the motor control device, which are not shown.

The charger 12 has an electrode section 12*a* for supplying charges to the photosensitive drum 11 to charge the same, a control grid 12*b* provided between the photosensitive drum 11 and the electrode section 12*a* for controlling a surface potential of the photosensitive drum 11, a metal case 12*c*, and a charging time measuring means 12*e* for measuring the charging time. The control grid 12*b* is connected with the case 12*c* via a bidirectional diode 12*d*. The bidirectional diode 12*d* keeps a potential difference between the control grid 12*b* and the case 12*c* constant under a voltage of not lower than a predetermined value.

The control grid 12*b* has the same polarity as that of a corona voltage emitted by the electrode section 12*a*. By adjusting the voltage of the control grid 12*b*, charges necessary to charge the surface of the photosensitive drum 11 to a predetermined potential level are applied to the photosensitive drum 11 (charging step). The voltage output control circuit 23 is connected with the electrode section 12*a* and the case 12*c* via a power source, not shown. The voltage output control circuit 23 controls the output of the power source.

The exposing device 13 emits laser light for exposing the photosensitive drum 11 in accordance with image data, to form an electrostatic latent image on the surface of the photosensitive drum 11 (exposing step).

Furthermore, the laser light is arranged so that its intensity can be switched.

The developer 14 develops the electrostatic latent image formed on the surface of the photosensitive drum 11 with a developer, to produce a toner image (developing step). The developer 14 is provided with a developing roller 14*a* vis-a-vis the photosensitive drum 11. The developing roller 14*a* rotates in a direction opposite to the rotation direction of the photosensitive drum 11, which the developing roller 14*a* faces, that is, in a direction such that the surface of the developing roller 14*a* moves from the transfer charger 15 side to the photosensitive drum 11 side (arrow B direction in FIG. 2), to develop the electrostatic latent image. The voltage output control circuit 23 is connected, like with the charger 12, with the developer 14 via a power source, not shown, and is to control the output of the power source.

The transfer charger 15 transfers a toner image obtained by development onto a transfer material (paper) 10 that is supplied from a paper feed section, not shown (transferring step). Thereafter, the transfer material 10 on which the toner image is transferred is discharged to outside the apparatus after being subjected to a fixing operation by a fixing section, not shown. The voltage output control circuit 23 is connected, like with the foregoing charger 12 and the developer 14, with the transfer charger 15 as well via a power source, not shown, and is to control the output of the power source.

The cleaning device 16 removes toners remaining on the surface of the photosensitive drum 11 after the transferring step (cleaning step). Further, the surface of photosensitive drum 11 is exposed by the exposing device 13 so that charges remaining thereon are removed (discharging step), and then, the operation proceeds to the next image forming process.

As described above, the voltage output control circuit 23 is connected with the charger 12, the developer 14, and the transfer charger 15 via the power source, not shown, and further, with the CPU 21 as well. The voltage output control circuit 23 is controlled by the CPU 21.

The foregoing CPU 21 is connected with, apart from the foregoing voltage output control circuit 23, the exposure power control circuit 22, the timer 24, and the detecting means 25. The exposure power control circuit 22 is connected with the exposing device 13. In other words, the exposing device 13 is connected with the CPU 21 via the exposure power control circuit 22. The timer 24 times a predetermined period of time for controlling the power source and a predetermined period of time for controlling the exposing operation of the exposing device 13. The CPU 21 controls the exposing operation of the voltage output control circuit 23 and the exposing device 13 by a timing determined by the timer 24.

In other words, the CPU 21, along with the voltage output control circuit 23, constitutes voltage control means, while along with the exposure power control circuit 22, constitutes exposing device control means. Therefore, the voltage output control circuit 23 controls the output of the power source by a predetermined timing determined by the timer 24 according to the control signal of the CPU 21, while the exposure power control circuit 22 also controls the exposing operation of the exposing device 13 according to the control signal of the CPU 21.

The detecting means 25 connected with the CPU 21 is to detect a rotation state of the photosensitive drum 11 (a rotation time, a rotation angle for a certain rotation time, etc.), and particularly to check an inertial rotation of the photosensitive drum 11, that is, a rotation of the photosensitive drum 11 by inertial force. At least one of timing means 25*a* and rotation angle measuring means 25*b* is provided as the detecting means 25. Incidentally, for convenience's sake, the detecting means 25 is shown in FIG. 2 as being disposed in the center of the photosensitive drum 11. The CPU 21 controls an exposure time, etc. based on a rotation condition of the photosensitive drum 11 detected by the detecting means 25.

Figure 3:
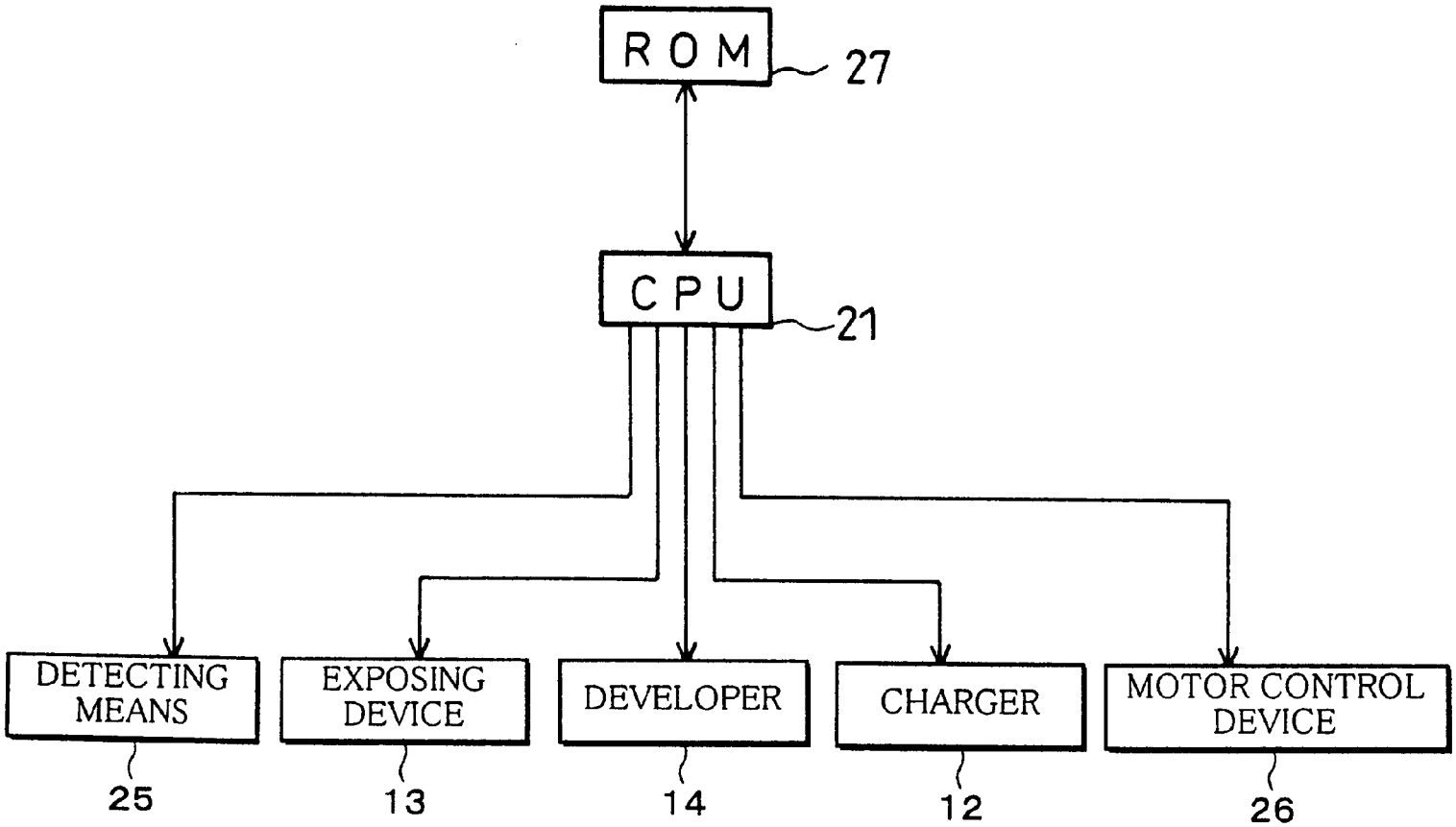
FIG. 3 is a chart illustrating a signal transfer route for a signal fed from a CPU shown in FIG. 2.

Furthermore, signals are fed from the CPU 21 to the respective components of the apparatus as shown in FIG. 3. More specifically, a flicker signal is fed from the CPU 21 to the exposing device 13 in accordance with a pattern stored in a ROM (memory means) 27. Furthermore, an OFF signal for turning off the DV bias voltage is fed from the CPU 21 via the voltage output control circuit 23 (not shown in FIG. 3) to the developing device 14. To the charger 12 as well, an OFF signal for stopping the charging operation is applied via the voltage output control circuit 23. To a motor control device 26 not shown in FIG. 2, an OFF signal for stopping the operation thereof is supplied. Besides, to the detecting means 25, an OFF signal for stopping the detection is supplied. Here, respective timings of the signals are determined in advance by measurement and calculation so that the photosensitive drum 11 has a predetermined potential at the development position, and the timings are stored in the ROM 27.

In the image forming apparatus arranged as above, in the case where any one of all troubles except an operational trouble of an exposure-use light source occurs during an image forming operation, the apparatus makes an emergency stop. Examples of the foregoing troubles include a trouble in carrying the transfer material 10 (paper jam, etc.), a trouble in an operation of a main driving motor, and low-temperature fixing failure.

As long as the image forming apparatus operates in a normal state without occurrence of a trouble, there is no problem in using the conventional exposure control method. However, if any one of the foregoing troubles occurs thereby causing the image forming apparatus to stop during an image forming operation, the image forming apparatus stops operating, in a state in which charges remaining on the surface of the photosensitive drum 11. If the charges remaining thereon (hereinafter referred to as remaining charges) are left without being removed, charges are gradually accumulated on the surface of the photosensitive drum 11 until the trouble causing the apparatus to stop operating is corrected thereby allowing the apparatus to restart. Consequently the surface potential of the photosensitive drum 11 increases, thereby greatly damaging the photosensitive drum 11.

Here, the motor for driving the photosensitive drum 11 to rotate also stops operating upon an emergency stop of the apparatus. However, after the motor stops, the photosensitive drum 11 itself continues rotating for a certain period of time by the inertial force, due to a fly-wheel effect of the photosensitive drum 11. In other words, the photosensitive drum 11 makes an inertial rotation for a certain period of time after stop of a driving operation of the motor for driving the photosensitive drum 11 to rotate. Therefore, in the present invention, the surface of the photosensitive drum 11 is exposed by the exposing means 13 during this inertial rotation, so that the remaining charges on the surface of the photosensitive drum 11 are removed (cancelled or deleted).

By thus removing the remaining charges from the surface part of the photosensitive drum, toner adhesion or carrier adhesion does not take place, upon restarting of the apparatus, in the case where control of the development bias voltage in a normal image forming operation is carried out. Consequently, damage can be prevented from occurring to the photosensitive drum 11. Note that in the following description exposure for removing charges is referred to as "discharge exposure", and exposure for image formation as "normal exposure".

Conventionally, in the case where charges remain on the surface of the photosensitive drum 11, the charges are removed by changing the development bias voltage. While such a scheme of changing the development bias voltage can be regarded as an active scheme, the scheme of the present invention, exposing the photosensitive drum 11 (projecting light thereto) to remove charges, can be regarded as a static scheme. Therefore, it is possible to remove charges from the photosensitive drum 11 "mildly", thereby reducing the damage to the photosensitive drum 11.

Furthermore, the discharge exposure in the present invention is preferably applied along with usual control (known technique) of the exposing device 13 that is applied upon normal stop of the photosensitive drum 11 for preventing toner adhesion or carrier adhesion. In this case, it is possible to effectively prevent toner adhesion or carrier adhesion to the photosensitive drum 11 upon both stop and resumption of rotation of the photosensitive drum 11. Consequently, this makes it possible to prevent damage to the photosensitive drum 11 and to improve safety.

Upon the occurrence of the foregoing troubles, charges remain on the surface of the photosensitive drum 11 in the cases that are assumed to be classified into the following two patterns.

One pattern (first trouble occurrence pattern) is such that a trouble occurs when a front end of a region charged by the charger 12 (hereinafter referred to as charged region) on the surface of the photosensitive drum 11 is being subjected to the charging step and then to the exposing step, or in other words, a trouble occurs immediately after the charging of the photosensitive drum 11 starts.

Figure 4:
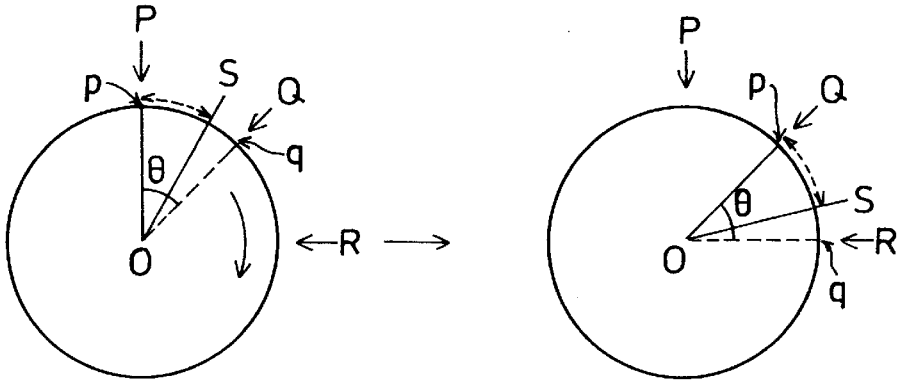
FIG. 4 is an explanatory view schematically illustrating an example of a state in which a photosensitive drum rotates upon occurrence of a trouble in the image forming apparatus shown in FIG. 2.

More specifically, as shown in FIG. 4, let a position associated with the surface of the photosensitive drum 11 vis-a-vis the charger 12, a position vis-a-vis the exposing device 13, and a position vis-a-vis the developing device 14 be a charging position P. an exposure position Q, and a development position R, respectively, and assume that the photosensitive drum 11 rotates through the positions P, Q, and R in this order. In this first trouble occurrence pattern, a trouble occurs when a front end S of the charged region is present between the charging position P and the exposure position Q.

Here, on the surface of the photosensitive drum 11 immediately after the occurrence of a trouble (see a drawing on the left hand side in FIG. 4), let a point of the surface at the position P and a point thereof at the position Q be a point p and a point q, respectively, while let the rotation axis of the photosensitive drum 11 be denoted as O. Then, let an angle formed between line segments Op and Oq be θ. Further, a region pS from the foregoing position p to the front end S (designated by a dot-line arc pS in FIG. 4) is a charged region.

A region to be discharged by the discharge exposure by the exposing device 13 (hereinafter referred to as charge remaining region) is the foregoing region pS, but actually for an entirety of the region pS to pass the exposure position Q, an uncharged region Sq ahead of the front end S (a region designated by an arc Sq in FIG. 4) has to pass the exposure position Q. Therefore, to discharge the entire region pS as the charge remaining region, an entirety of the region pq on the photosensitive drum 11 should pass the exposure position Q.

In other words, by rotating the photosensitive drum 11 through the angle θ formed between the line segments Op and Oq since the trouble occurrence, the region pS as the charge remaining region can be completely discharged.

Figure 5:
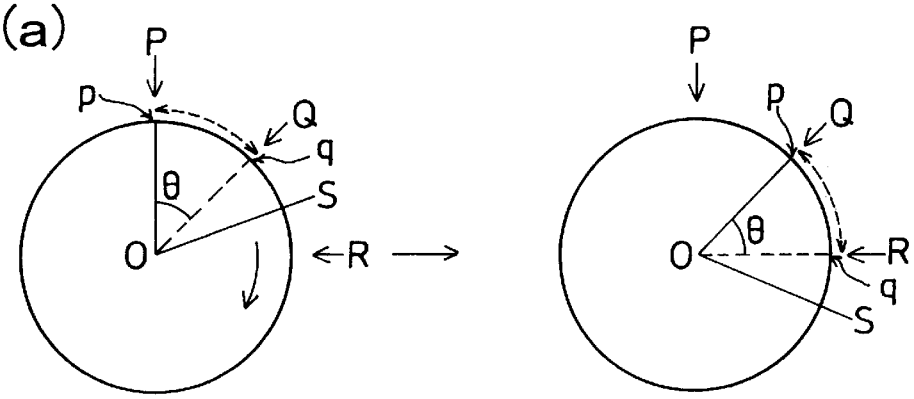
FIG. 5(*a*) and 5(*b*) are explanatory views schematically illustrating other examples of a state in which the photosensitive drum rotates upon occurrence of a trouble in the image forming apparatus shown in FIG. 2.
Figure 5:
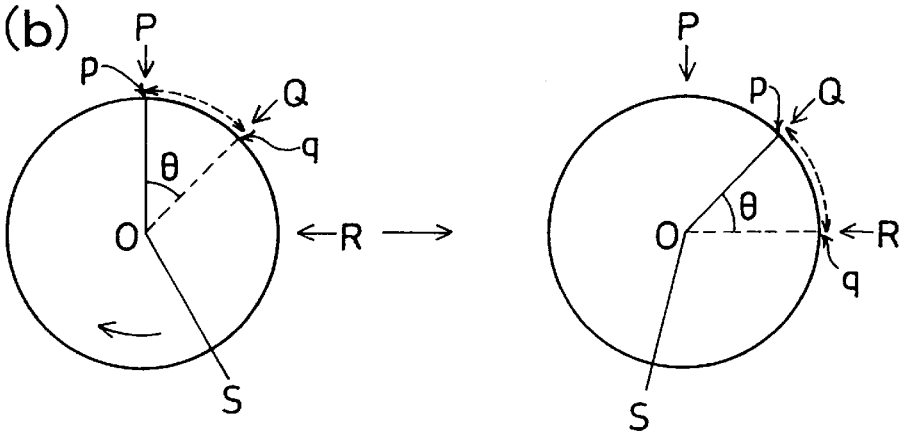

On the other hand, the other pattern (second trouble occurrence pattern) is a usual trouble occurrence pattern such that a trouble occurs after the front end S of the charged region passes the exposure position Q as shown in FIGS. 5(*a*) and 5(*b*). In this case, the charge remaining region is a region from the position p to the position q, that is, the region pq (designated by the dot-line arc pq in FIGS. 5(*a*) and 5(*b*)).

In other words, the charging is started with respect to the front end S, but by the normal image forming operation of the photosensitive drum 11, an entire region having passed the exposure position Q, among the charged region, has been discharged by discharge exposure. Therefore, the region pq not having passed the exposure position Q is a charge remaining region.

Therefore, in the second trouble occurrence pattern, like in the first trouble occurrence pattern, by rotating the photosensitive drum 11 through the angle θ formed between the line segments Op and Oq since the trouble occurrence, the region pq as the charge remaining region can be completely discharged.

In other words, in both the first and second trouble occurrence patterns, by rotating the photosensitive drum 11 through the angle θ corresponding to the region pq, the entire charge remaining region can be discharged.

Incidentally, for convenience's sake, respective positions of the front end S in FIGS. 5(*a*) and 5(*b*) are different from each other, but in the second trouble occurrence pattern the front end S may be at any position as long as it is not between the charging position P and the exposure position Q.

Figure 1:
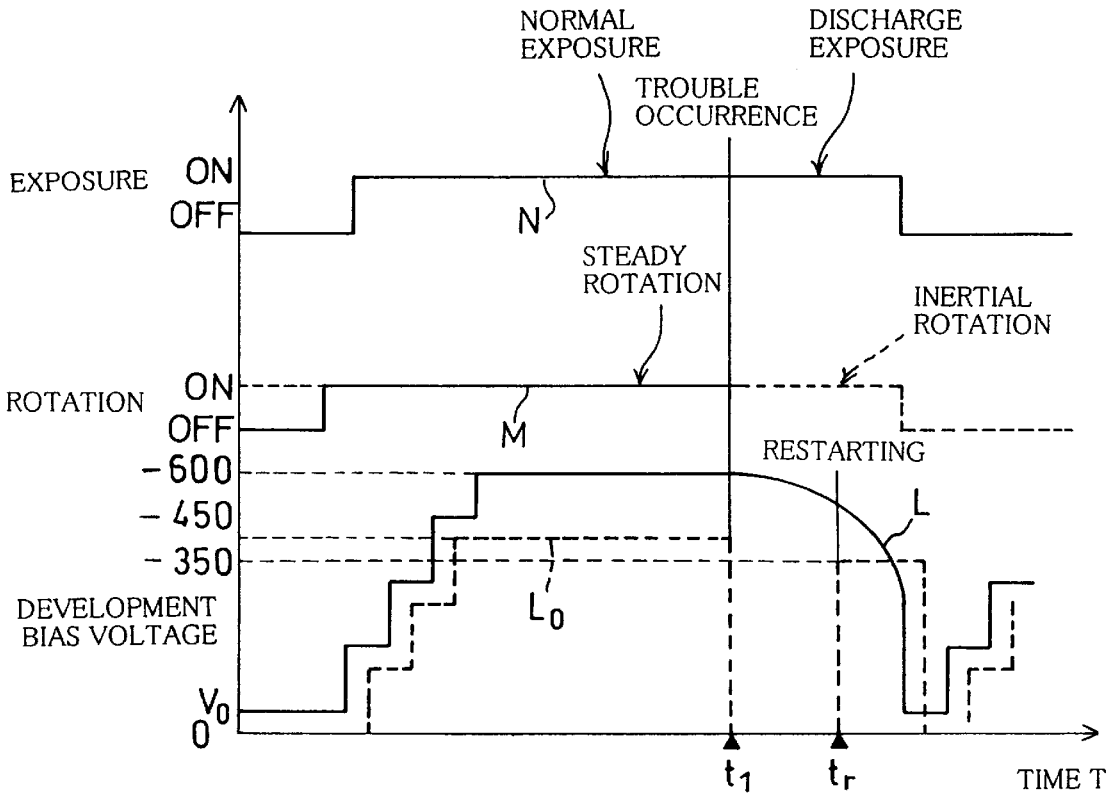
FIG. 1 is a timing chart showing an operation for control of an exposing device for discharge exposure and a photosensitive drum in an image forming apparatus in accordance with an embodiment of the present invention.

The discharge exposure by the exposing device 13 during the inertial rotation of the photosensitive drum 11 is, as shown in the timing chart of FIG. 1, controlled in accordance with respective timings of the surface potential of the photosensitive drum 11, the development bias voltage applied to the photosensitive drum 11, a rotation driving time of the photosensitive drum 11, and the exposure time by the exposing device 13.

In FIG. 1, a chart L in the bottom part represents the surface potential of the photosensitive drum 11, a dot-line chart $L_0$ represents the development bias voltage, the chart M in the middle part represents the driving time of the photosensitive drum 11, and a chart N in the top part represents the exposure time by the exposing device 13. The ordinate represents time T.

Upon start of an image forming operation, the photosensitive drum 11 starts rotating as shown in the chart M (shift from OFF to ON), while the surface potential of the photosensitive drum 11 stepwisely rises form a base value $V_0$ as shown in the chart L, as charged by the charger 12 (herein, the surface potential rises to at most −600V). As shown by the chart $L_0$, the development bias voltage rises likewise (the development bias voltage rises to at most −450V). Furthermore, as shown in the chart N, the normal exposure for image formation by the exposing device 13 starts, slightly behind the start of rotation of the photosensitive drum 11 (shift from OFF to ON).

Here, upon occurrence of a trouble at a time tl, the surface potential of the photosensitive drum 11 gradually declines, as shown in the chart L. However, since charges remain on the surface of the photosensitive drum 11, a discharging process has to be applied thereto. Therefore, discharge exposure is carried out by the exposing device 13 having carried out the normal exposure, as shown in the chart N. Here, the motor driving the photosensitive drum 11 stops upon the trouble occurrence, but the photosensitive drum 11 makes rotation (inertial rotation) by the inertial force of the driving to some extent, as shown by a dot-line part of the chart M. During this inertial rotation, the discharge exposure is carried out by the exposing device 13. Note that the development bias voltage becomes 0V as shown by the chart $L_0$.

After the trouble is corrected and the apparatus restarts at a time $t_r$, the development bias voltage rises again as shown by the chart $L_0$ (to −350V in FIG. 1), while the photosensitive drum 11 continues inertial rotation as shown by the charts M and N, thereby causing the discharge exposure to continue as well. Therefore, as shown by the chart L, the surface potential of the photosensitive drum 11 continuously drops, finally to the base value $V_0$ which is a potential in a state before the charging. Simultaneously the development bias voltage falls to 0V as shown by the chart $L_0$. Thereafter, after the inertial rotation and the discharge exposure end, the development bias voltage and the surface potential stepwisely rise as shown by the charts $L_0$ and L.

Figure 6:
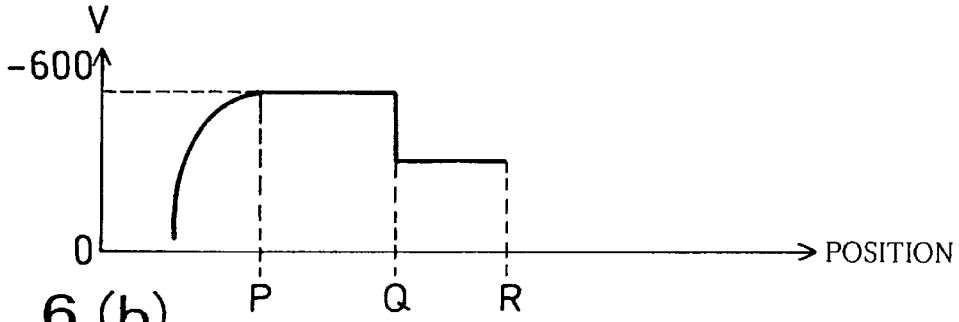
FIGS. 6(*a*) through 6(*c*) are graphs showing relationship between a position of a photosensitive drum surface and a surface potential in the case where the discharge exposure shown in FIG. 1 finishes during an inertial rotation of the photosensitive drum.
Figure 6:
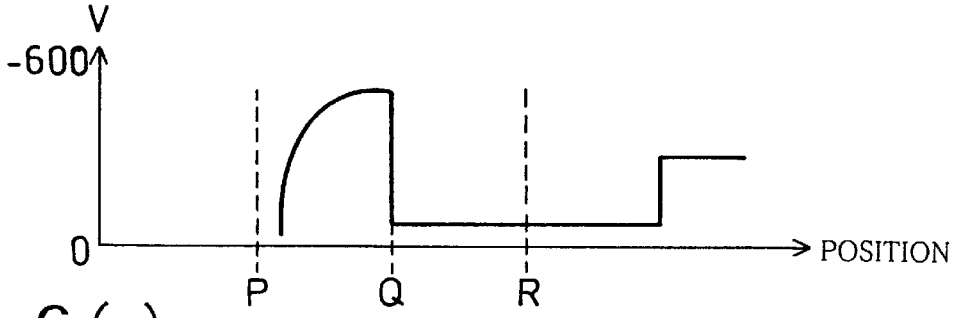
Figure 6:
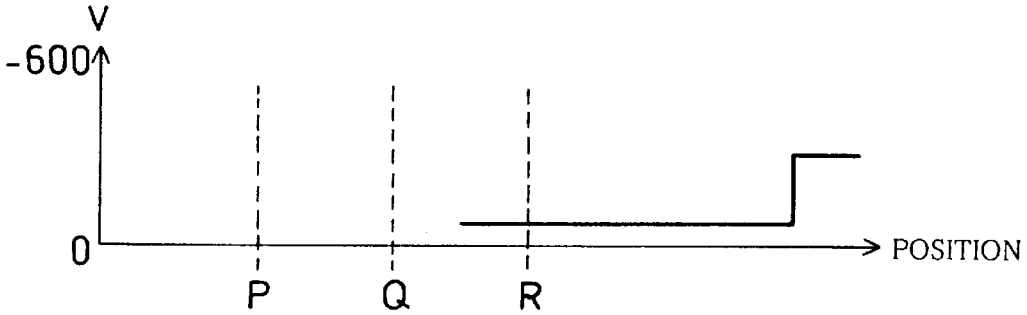

Next, the discharge exposure carried out during the inertial rotation of the photosensitive drum 11 is explained based on changes on the surface potential of the photosensitive drum 11. First of all, the surface potential of the photosensitive drum 11, in a certain portion of the surface part, immediately after an emergency stop of the apparatus upon occurrence of a trouble gradually rises until the portion reaches the position P, as shown in FIG. 6(*a*). While the portion moves from the charging position P to the exposure position Q, the portion maintains a certain predetermined potential (−600V in FIG. 6(*a*)). A region on the surface of the photosensitive drum 11 in which the portion maintains the predetermined potential is the region pq shown in FIGS. 5(*a*) and 5(*b*). At the exposure position Q, laser light is projected on the surface of the photosensitive drum 11 by the exposing device 13 (in this case, normal exposure), thereby causing the surface potential to lower. The portion whose surface potential has lowered moves to the development position R.

Observing the surface potential of the photosensitive drum 11 when a time $T_1$ has passed after the emergency stop, the photosensitive drum 11 has been rotated by the inertial force due to the fly-wheel effect, and this inertial rotation causes the surface to be exposed and discharged by the exposing device 13, or namely, causes the removal of remaining charges to start, as shown in FIG. 6(*b*). Therefore, the surface potential of the photosensitive drum 11 at the predetermined value at the exposure position Q lowers to the base value (close to −0V in FIG. 6(*b*)) when reaching the development position R.

Then, observing the surface potential of the photosensitive drum 11 when a time $T_2$ has passed after the emergency stop, the portion of the surface of the photosensitive drum 11 that exhibited a high potential immediately after the emergency stop (the region pq in FIGS. 5(*a*) and 5(*b*), i.e., the charge remaining region) has entirely passed the exposure position Q. Therefore, the surface potential of the photosensitive drum 11 is substantially completely lowered to the base value by the discharge exposure during the inertial rotation of the photosensitive drum 11.

As described above, the image forming apparatus of the present invention is arranged so that, after the apparatus stops operating due to occurrence of a trouble, the surface of the photosensitive drum 11 is discharged by exposure by the exposing device 13 while the photosensitive drum 11 makes inertial rotation. This ensures that charges remaining on the surface of the photosensitive drum 11 due to the charging immediately before the trouble occurrence are removed therefrom. Therefore, independent discharging means need not be provided, thereby allowing the arrangement of the apparatus to be simplified. Besides, this enables to prevent adhesion of toner or carrier onto the surface of the photosensitive drum 11, and hence, to prevent excessive accumulation of charges and damage to the photosensitive drum 11, thereby to enhance safety.

Furthermore, since the discharge is carried out during inertial rotation of the photosensitive drum 11, it is possible to immediately shift to the next image forming operation upon restarting after the trouble is corrected. Therefore, an operation time for carrying out discharge needs not be provided after the correction of trouble, thereby ensuring drastic improvement of the operational efficiency of the apparatus.

Second Embodiment

The following description will explain another embodiment of the present invention while referring to FIGS. 7 through 13. Incidentally, the present invention is not limited to this embodiment. For conveniences' sake, the members having the same structure (function) as those in the first embodiment will be designated by the same reference numerals and their description will be omitted.

In the First Embodiment, charges remaining on the surface of the photosensitive drum 11 are removed therefrom by discharge exposure applied thereto by the exposing device 13 during the inertial rotation of the photosensitive drum 11. Here, there is no problem if the discharge exposure finishes during the inertial rotation of the photosensitive drum 11: but otherwise, namely, if the inertial rotation ends before the discharge exposure finishes, the entirety of the charge remaining region cannot be subjected to the discharging operation.

Therefore, an image forming apparatus in accordance with the present embodiment is arranged as follows: power supply starts upon restarting of the apparatus, and when rotation of the photosensitive drum 11 is started, the discharge exposure by the exposing device 13 is immediately carried out.

In the present invention, as described in the above description on the First Embodiment, discharge ideally finishes within the inertial rotation time of the photosensitive drum 11 (see FIGS. 6(*a*) through 6(*c*)). Actually, however, since the inertial rotation time of the photosensitive drum 11 greatly varies with the arrangement of the image forming apparatus and environment surrounding the apparatus, discharge may not finish during the inertial rotation time.

Figure 7:
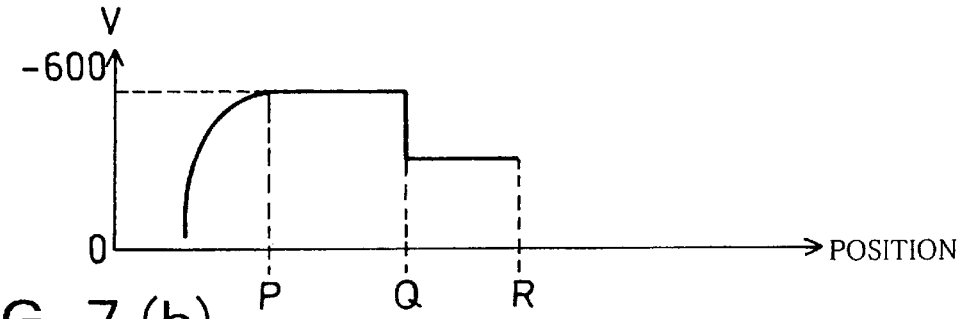
FIGS. 7(*a*) through 7(*c*) are graphs showing relationship between the position of the photosensitive drum surface and the surface potential in the case where the inertial rotation of the photosensitive drum ends before the discharge exposure shown in FIG. 1 finishes.
Figure 7:
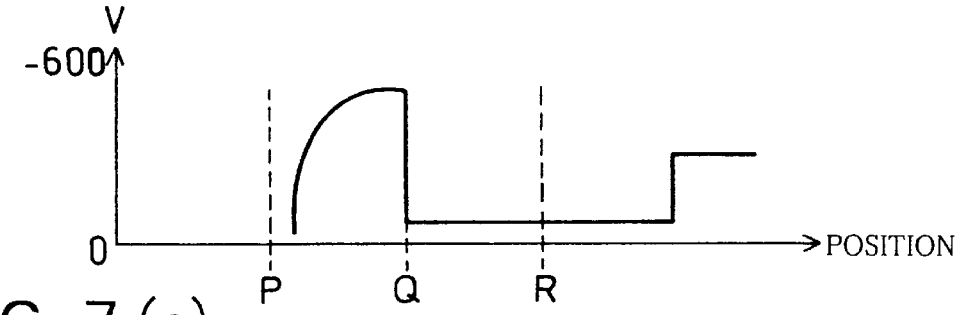
Figure 7:
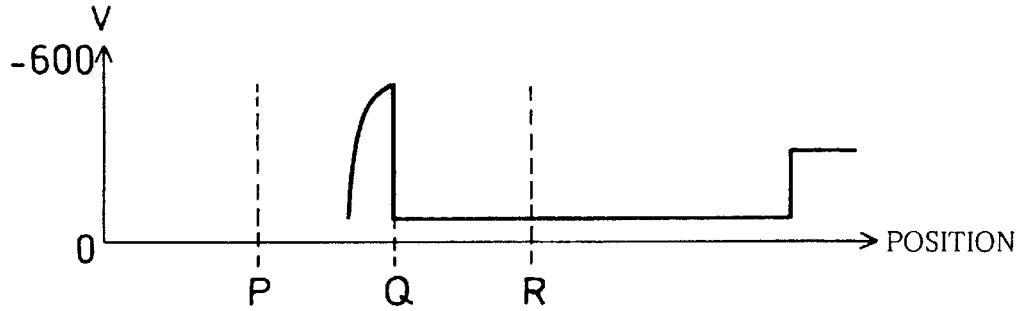

In other words, as shown in FIGS. 7(*a*) and 7(*b*), until a time $T_1$ passes since the trouble occurrence, charges remaining on the surface of the photosensitive drum 11 are removed by discharge exposure like in the case of FIGS. 6(*a*) and 6(*b*). However, in the case where the inertial rotation of the photosensitive drum 11 stops before the discharging operation finishes, the photosensitive drum 11 is left in a state in which charges remain on the surface thereof as shown in FIG. 7(*c*), after a time $T_2$ passes since the emergency stop.

Then, in the case where, to remove the remaining charges, the discharge exposure is continued in the state in which the photosensitive drum 11 remains unmoved, a specific part of the photosensitive drum 11 is irradiated with light of a great intensity. Consequently, the part of the photosensitive drum 11 is excessively exposed to light, and the surface of the photosensitive drum 11 cannot be uniformly charged in the charging step of the next image forming process, with the specific part having a lower potential: namely, so called exposure memory occurs. Therefore, it is not preferable to carry out discharge exposure in the state in which rotation of the photosensitive drum 11 stops.

Furthermore, the time of inertial rotation of the photosensitive drum 11 drastically varies with the arrangement of the information forming apparatus and the environment surrounding the apparatus, as described above. The environment surrounding the apparatus refer to, for example, changes of the temperature and moisture, or namely, temperature and moisture conditions. Changes in temperature and moisture around the image forming apparatus cause the component members to undergo thermal expansion or the like, and clearance, lubrication conditions, etc. between the component members are adversely affected. Since changes in temperature and moisture conditions particularly influence factors that may produce resistances in rotational driving systems, such changes cause the length of the inertial rotation time to be shortened or prolonged.

Furthermore, the environment surrounding the apparatus also refers to the state of use of the apparatus (particularly, frequency of use): the state of use determines a degree of abrasion and fatigue of members of rotational driving systems. Moreover, it also refers to dustiness, for example: whether the apparatus is used in a relatively clean environment and unlikely affected by dust, or the apparatus is placed in the vicinity of a place where dust is likely produced. Incidentally, a high frequency of use unnecessarily leads to a higher degree of abrasion and fatigue of the members, and a state of use in which rotation and stop of the photosensitive drum 11 are frequently carried out can be regarded as the harshest condition for the image forming apparatus.

Furthermore, to concretely explain variation of the inertial rotation depending on the arrangement of the image forming apparatus, the rotation of the motor stops when occurrence of a trouble causes the apparatus to stop thereby to stop supply of power to the motor, while the photosensitive drum 11 continues to rotate by the inertial force (inertial rotation) as described above. But in the case where the cleaning device 16 is equipped with a blade in contact with the surface of the photosensitive drum 11, a braking effect for hindering the rotation of the photosensitive drum 11 is applied by the blade. Therefore, a greater braking effect by the blade will make the time of the inertial rotation of the photosensitive drum 11 shorter.

Alternatively, considering the time of inertial rotation by the fly-wheel effect of the photosensitive drum 11 itself, the time of inertial rotation greatly varies with the size and the rotation speed of the motor. Furthermore, in a common arrangement, the stop of the motor for driving the photosensitive drum 11 itself produces the braking effect.

Thus, with a certain environment surrounding the apparatus and a certain detailed arrangement of the apparatus, the photosensitive drum 11 might not be allowed to make inertial rotation to such an extent as to be subjected to sufficient discharge exposure by the exposing device 13.

To cope with this, the exposing operation is controlled by the CPU 21 (see FIG. 2) so that the surface of the photosensitive drum 11 is discharged by exposure by the exposing device 13, upon resumption of rotation of the photosensitive drum 11 upon restarting of the image forming apparatus. This ensures that charges remaining on the surface of the photosensitive drum 11, which are generated on an emergency stop, can be surely removed. Therefore, even with development bias control of a usual image forming operation upon restarting, toner adhesion or carrier adhesion can be effectively avoided.

The following description will explain operation control of the exposing device 13 for carrying out discharge exposure upon restarting, due to incompleteness of the discharge exposure during the inertial rotation.

The rotation of the photosensitive drum 11 can be classified into a steady rotation state of being normally driven by the motor and a decelerating rotation state which is caused by stop of the driving by the motor upon occurrence of a trouble.

Since the steady rotation state is a normal image forming operation, the photosensitive drum 11 rotates at a constant angular velocity of $\omega=\omega_0$. Here, let a time required for a certain portion of the surface of the photosensitive drum 11 in the steady rotation state to move from the charging position P and the exposure position Q be a predetermined time $t_a$ and let a certain time of the rotation of the photosensitive drum 11 be a reference time (rotation time t=0), then an angle corresponding to an advance (hereinafter referred to as rotation angle) during the predetermined time $t_a$ is constantly $\theta$ at all times (when $t=t_a$, $t=2t_a$) Therefore, the charged region of the surface of the photosensitive drum 11, which is charged at the charging position P, is completely discharged during the predetermined time $t_a$.

Figure 8:
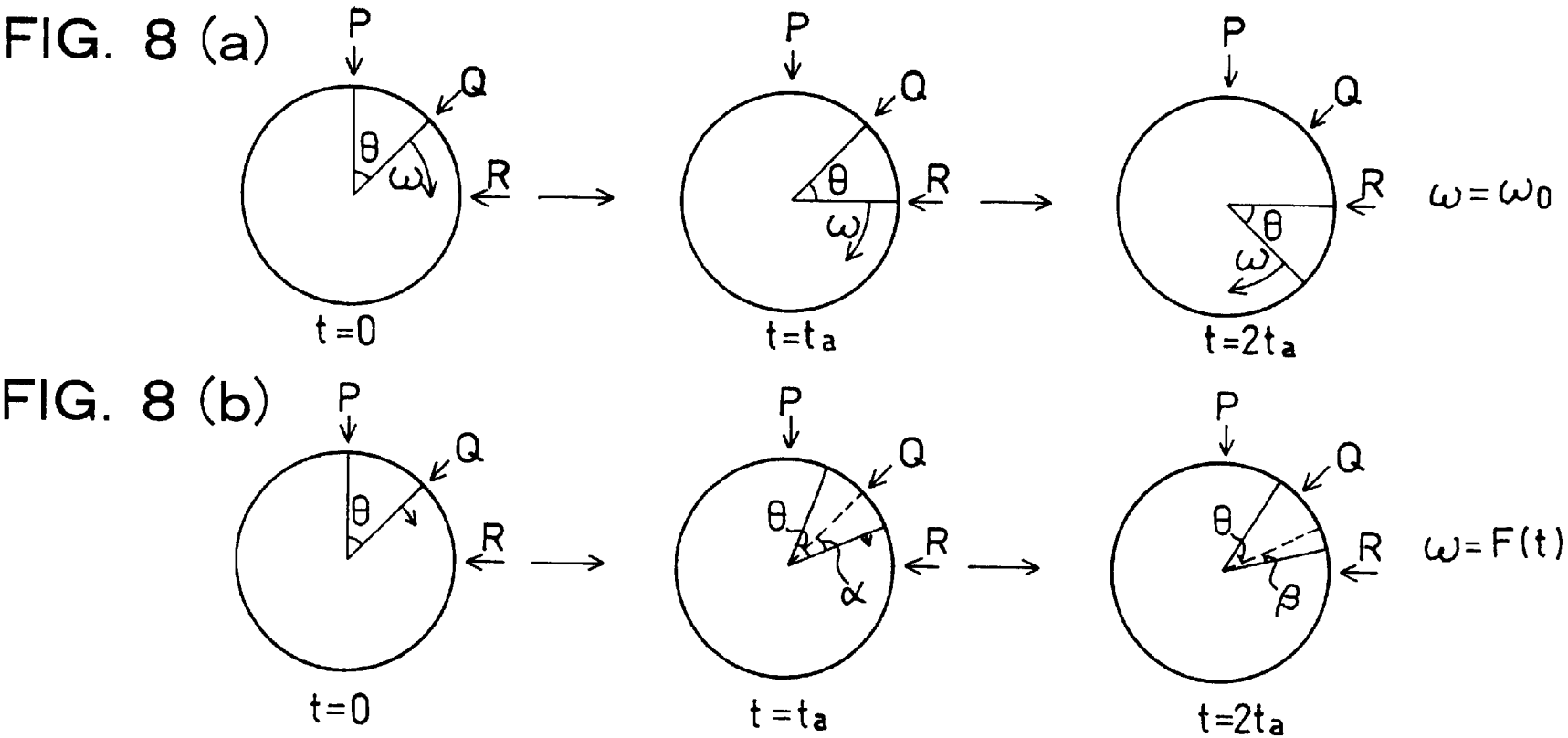
FIG. 8(*a*) is an explanatory view schematically illustrating a rotation angle of the photosensitive drum shown in FIG. 2 in a steady rotation state.

On the other hand, in the decelerating rotation state following to the trouble occurrence, the photosensitive drum 11 does not rotate at a constant angular velocity $\omega$, but decelerates as rotating. More specifically, as shown in FIG. 8(*b*), let the rotation time t of the photosensitive drum 11 immediately after occurrence of a trouble be a reference time (t=0), then the rotation angle is reduced to $\alpha$ ($\alpha<\theta$) when the predetermined time $t_a$ has passed ($t=t_a$), and then, the rotation angle is further reduced to $\beta$ ($\beta<\alpha<\theta$) when the predetermined time $t_a$ has further passed ($t=2t_a$). Since the inertial rotation of the photosensitive drum 11 is in such a decelerating rotation state, the charge remaining region corresponding to the angle $\theta$ may not be completely discharged by exposure at the exposure position Q. Incidentally, the angular velocity $\omega$ in the decelerating rotation state can be approximated by a function expressed with the rotation time t of the photosensitive drum 11, namely, $\omega=F(t)$.

Regarding the decelerating rotation state, relationship between the angular velocity $\omega$ and the rotation time t of the photosensitive drum 11 will be explained below, in comparison with the steady rotation state.

Figure 9:
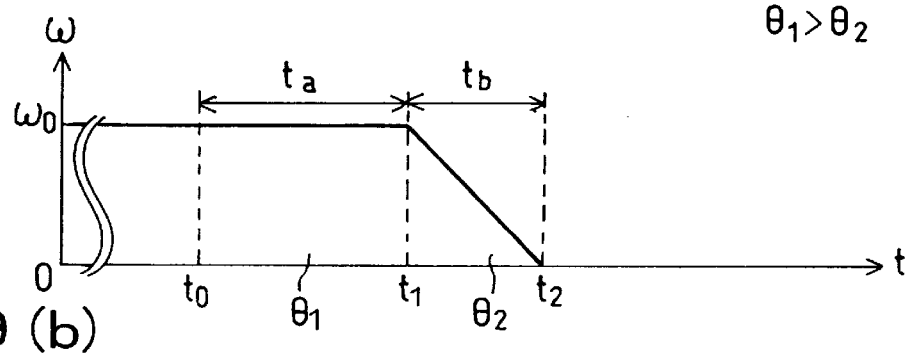
FIG. 9(*a*) is a graph showing angular velocity-rotation time relationship in the case where discharge exposure does not finish during an inertial rotation of the photosensitive drum shown in FIG. 2.
Figure 9:
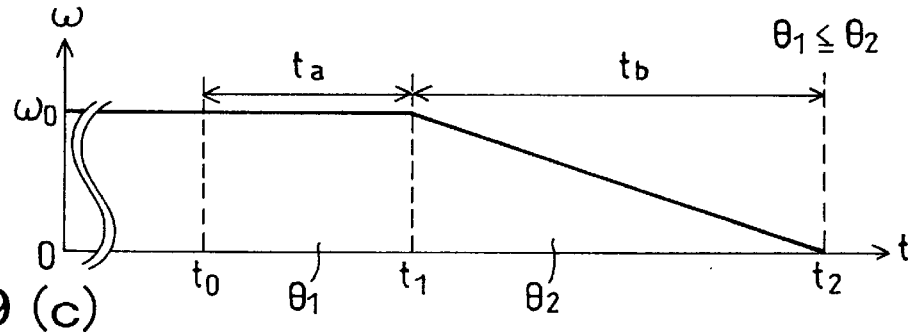
Figure 9:
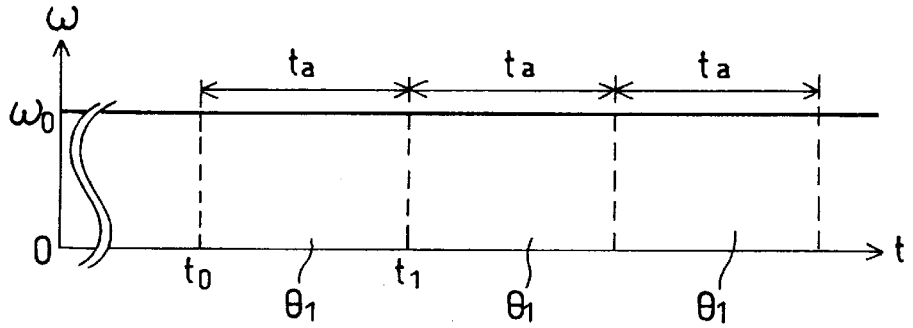

First of all, in the steady rotation state, let the time satisfying $t=t_0$ (t is the rotation time) be a reference time, and assume that the entirety of the charged region on the surface of the photosensitive drum 11 has passed the exposure position Q when $t=t_1$. In other words, in the steady rotation state, the foregoing predetermined time $t_a$ required to completely discharge the region pq of the surface of the photosensitive drum 11 (charged region) is derived as $t_a=t_1-t_0$. In the case where no trouble occurs to the image forming apparatus, as shown in FIG. 9(*c*), the photosensitive drum 11 is in the steady rotation state in which the angular velocity $\omega$ in the rotation of the photosensitive drum 11 is constant ($\omega=\omega_0$) at all times. Therefore, the rotation angle $\theta$ during the predetermined time $t_a$ is constant at all times ($\theta=\theta_1$).

On the other hand, in the case where a trouble occurs at a timing when the rotation time t satisfies $t=t_1$, the photosensitive drum 11 makes inertial rotation in the decelerating rotation state since when $t=t_1$. Then, as shown in FIGS. 9(*a*) and 9(*b*), the rotation stops when the rotation time t satisfies $t=t_2$.

Desirably, discharge exposure of the entire region pq (charge remaining region, since the photosensitive drum 11 is in the decelerating rotation state) at the exposure position Q is completed during the inertial rotation time since when $t=t_1$ until when $t=t_2$, and herein the rotation angle $\theta_2$ of the photosensitive drum 11 during the inertial rotation time should be not smaller than the rotation angle $\theta_1$ during the predetermined time $t_a$ required for the entire charged region of the surface of the photosensitive drum 11 steadily rotating to pass the exposure position Q ($\theta_1\leqq\theta_2$) In other words, let the inertial rotation time of the photosensitive drum 11 be $t_b=t_2-t_1$, and the rotation angle of the photosensitive drum 11 during the inertial rotation time $t_b$ is required to be not smaller than the rotation angle $\theta_1$ of the photosensitive drum 11 during the foregoing predetermined time $t_a$.

Therefore, in the case where $\theta_1\leqq\theta_2$, as shown in FIG. 9(*b*), the charge remaining region can be entirely discharged by exposure during the inertial rotation time $t_b$. In the case where $\theta_1>\theta_2$, as shown in FIG. 9(*a*) conversely the charge remaining region cannot be entirely discharged by exposure during the inertial rotation time $t_b$, and charges further remain on the surface of the photosensitive drum 11. Therefore, whether or not the discharge exposure is completed during the inertial rotation time $t_b$ can be judged from relationship between the rotation angles $\theta_1$ and $\theta_2$.

Here, to express the rotation angle $\theta$ with the rotation time t and the angular velocity $\omega$ of the photosensitive drum 11, the rotation angle $\theta_1$ in the steady rotation state is expressed as $\theta_1=\omega_0\cdot t_a$ since the constant angular velocity $\omega_0$ is maintained during the predetermined time $t_a$. On the other hand, during the inertial rotation time $t_b$, the angular velocity in the decelerating rotation state can be expressed as $\omega=F(t)$, as described above. Therefore, the rotation angle $\theta_2$ can be expressed as integration result of the angular velocity $\omega=F(t)$ during the rotation time $t_1$ to the rotation time $t_2$.

Furthermore, the following expression (1) is derived from an area corresponding to the rotation angle $\theta_1$ shown in FIGS. 9(*a*) and 9(*b*), and likewise, the following expression (2) is derived from an area corresponding to the rotation angle $\theta_2$:

$$\theta_1=\omega_0\cdot t_a=\omega_0\cdot(t_1-t_0) \tag{1}$$

$$\theta_2=\tfrac{1}{2}\cdot\omega_0\cdot t_b=\tfrac{1}{2}\cdot\omega_0\cdot(t_2-t_1) \tag{2}$$

Here, to completely discharge the whole region during the decelerating rotation of the photosensitive drum 11, it is necessary that at least the area corresponding to the rotation angle $\theta_1$ and that corresponding to the rotation angle $\theta_2$ in FIGS. 9(*a*) and 9(*b*) should be equal ($\theta_1=\theta_2$). Therefore, to establish $\theta_1=\theta_2$, the following expression (3) need be established based on the foregoing expressions (1) and (2).

$$\theta_1=\theta_2$$

$$\omega_0\cdot(t_1-t_0)=\tfrac{1}{2}\omega_0\cdot(t_2-t_1)$$

$$2(t_1-t_0)=t_2-t_1 \tag{3}$$

In other words, as $t_2-t_1$ approximates to $2(t_1-t_0)$, ideal discharge is enabled. However, since $t_2$ is uncertain, the known $t_2-t_1$ is actually used, and it is assumed that $t_2-t_1$ approximates to $2(t_1-t_0)$. Then, based on the foregoing expression (3) as established above, the relationship expressed as the following expression (4) is established:

$$t_2-t_1=2(t_1-t_0)\geqq t_1-t_0 \tag{4}$$

Thus, the foregoing relationship $\theta_1\leqq\theta_2$ can be approximated as the relationship expressed by the foregoing expression (4) with only the rotation time t. Therefore, $\theta_1\leqq\theta_2$ can be approximated as $t_1-t_0\leqq t_2-t_1$ by using the rotation time t, that is, $2t_a\leqq t_b$.

More specifically, as shown in FIG. 9(*b*), in the ideal case in which the entire charged region can be discharged by exposure during the inertial rotation time $t_b$, the predetermined time $t_a$ is not longer than the inertial rotation time $t_b$ of the photosensitive drum 11 ($t_a\leqq t_b$). On the other hand, as shown in FIG. 9(*a*), in the case where the entire charged region cannot be discharged by exposure during the inertial rotation time $t_b$ and a region where charges remain is produced, the predetermined time $t_a$ is longer than the inertial rotation time $t_b$ ($t_a>t_b$) Therefore, whether or not the discharge by exposure finishes can be also judged from the relationship between the predetermined time $t_a$ and the inertial rotation time $t_b$.

Thus, by using the rotation angle θ and the rotation time t as parameters to observe and set the inertial rotation state and conditions of the exposure by the exposing device 13, whether or not the discharge finishes during the inertial rotation time $t_b$ of the photosensitive drum 11 is judged, and the judgment result is used for controlling the discharging operation of the exposing device 13.

Here, since a constant angular velocity $\omega=\omega_0$ is obtained in the steady rotation state of the photosensitive drum 11, the foregoing predetermined time $t_a$ can be previously set. Therefore, the period of time required for the discharge by exposure by the exposing device 13 (discharge exposure time) can be calculated and set by using the foregoing predetermined time $t_a$. Accordingly, the foregoing predetermined time $t_a$ since the charging of the photosensitive drum 11 steadily rotating until the exposure finishes is used for setting the exposure condition for exposure control. Note that in the case where the rotation angle θ is used as a parameter for the exposure condition, the foregoing predetermined rotation angle since the charging of the photosensitive drum 11 steadily rotating until the exposure finishes is used for setting the exposure condition. In other words, the foregoing predetermined time $t_a$ and the predetermined rotation angle are predetermined conditions for setting the exposure condition.

Conversely, since the inertial rotation time $t_b$ of the photosensitive drum 11, as described above, greatly varies with the detailed arrangements of the image forming apparatus and the environment surrounding the apparatus, it is difficult to presume the inertial rotation time $t_b$ upon discharge exposure. Therefore, by observing the inertial rotation time $t_b$ as an inertial rotation state, the observation result is compared with the exposure condition, to control the discharge exposure.

By observing the inertial rotation time $t_b$ of the photosensitive drum 11, it is possible to recognize the charge remaining region between the charging position P and the exposure position Q. Therefore, if the discharge exposure with respect to the photosensitive drum 11 does not finish during the inertial rotation time $t_b$, the charge remaining region can be surely discharged upon the restarting.

The following two concrete methods are applicable as a control method in the case where the foregoing rotation time t is used as a parameter for the inertial rotation state and the exposure condition.

One of the methods is a method (first method) in which (i) a period of time since start of a charging operation with respect to the photosensitive drum 11 until stop of power supply upon occurrence of a trouble is measured, and (ii) the inertial rotation time $t_b$ since the stop of power supply until the complete stop of rotation of the photosensitive drum 11 is observed. In this method, a discharge exposure time is set based on the predetermined time $t_a$, which has previously been known, and a charging time measured, and the discharge exposure time and the observation result of the inertial rotation time $t_b$ are compared and discharge exposure is carried out based on the comparison result. Therefore, it is possible to carry out discharge exposure upon restarting, if discharge exposure is not completed during the inertial rotation time $t_b$.

In an image forming apparatus using this method, the detecting means 25 is provided with at least a timing means 25*a*, while the charger 12 is equipped with a charging time measuring means 12*e* (see FIG. 2). The foregoing timing means 25*a* measures the inertial rotation time $t_b$ and outputs the measurement result to the CPU 21. The CPU 21 observes the inertial rotation time $t_b$ based on the measurement result. Therefore, the timing means 25*a* functions as inertial rotation time observing means.

Figure 10:
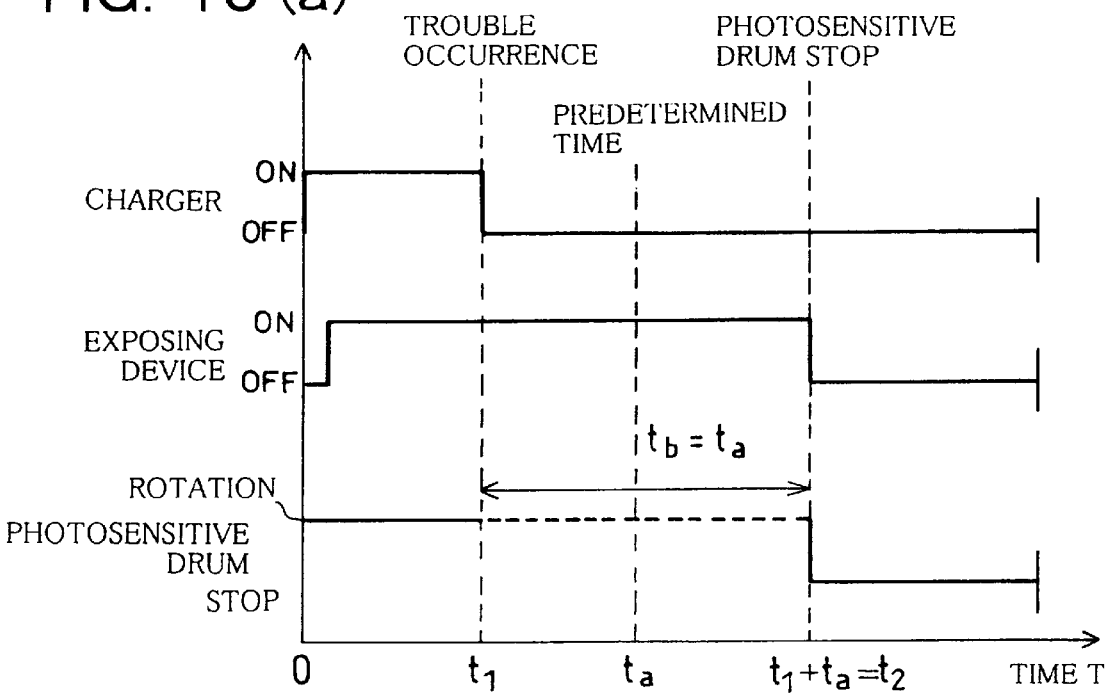
FIG. 10(*a*) is a timing chart showing an example of operations of a charger, an exposing device, and the photosensitive drum in the case where the discharge exposure finishes during an inertial rotation of the photosensitive drum shown in FIG. 2.
Figure 10:
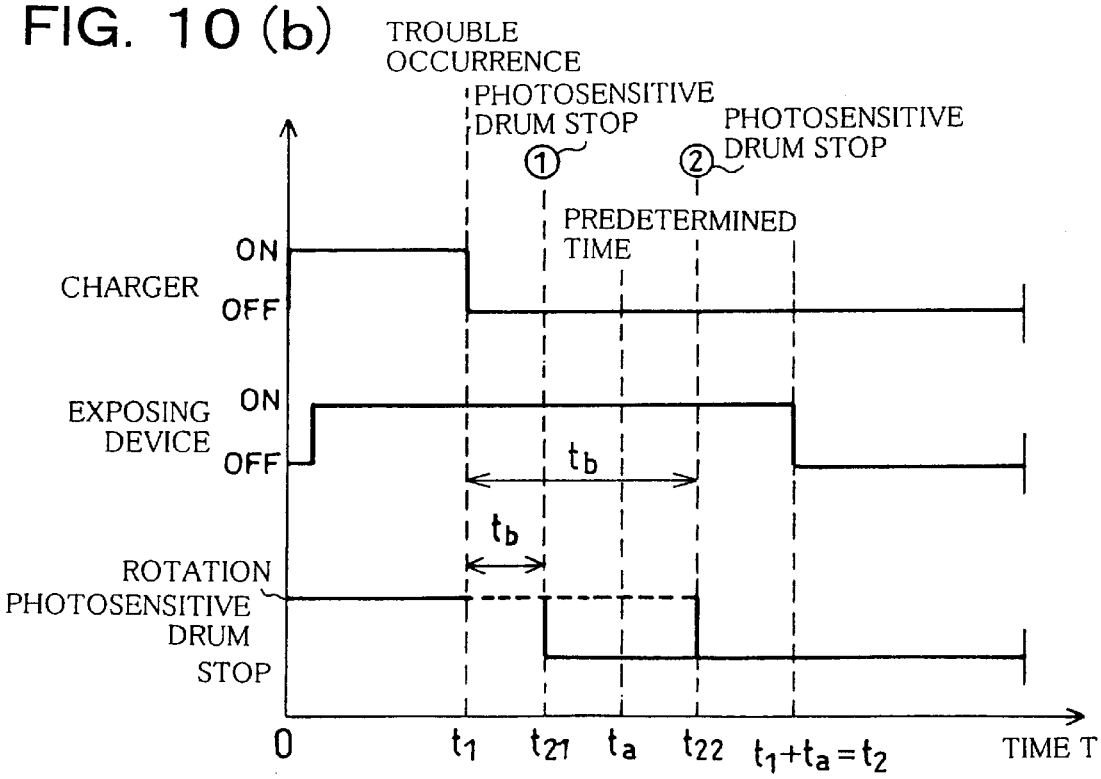

The following description will explain relationship of the rotation of the photosensitive drum 11 with the charging by the charger 12 and the exposure by the exposing means 13 (normal exposure, discharge exposure) in the control of the discharge exposure in accordance with the foregoing first method, while referring to FIGS. 10(*a*) and 10(*b*). Incidentally, in FIGS. 10(*a*) and 10(*b*) and FIGS. 11(*a*) and 11(*b*), time T (comprehending the rotation time t) is plotted as ordinate.

FIG. 10(*a*) shows an ideal case in which the discharge exposure corresponding to the charging time can finish within the inertial rotation time $t_b$. Let the time at which the charging by the charger 12 starts and a time at which a trouble occurs be a time satisfying t=0, and a time $t_1$, respectively. Then, a period of time (predetermined time) during which the photosensitive drum 11 in the steady rotation state rotates from the charging position P to the exposure position Q be $t_a=t_1-t_0$.

In other words, a period of time during which the rotation time t varies from t=0 to $t=t_1$ is a charging time while the charger 12 charges the photosensitive drum 11, and a normal exposure time while the exposing device 13 carries out normal exposure (exposure for image formation), as well as a driving time while the photosensitive drum 11 rotates in the steady rotation state. Then, a period of time after the occurrence of a trouble, while the rotation time t is in a range of from $t=t_1$ to $t=t_1+t_a$, is a time while the charger 12 stops charging (OFF) due to the trouble, the discharge exposure time while the exposing device 13 carries out discharge exposure, and the inertial rotation time $t_b$ while the photosensitive drum 11 makes inertial rotation in the decelerating rotation state.

Here, the predetermined time $t_a$ is an ideal time required for the photosensitive drum 11 to stop rotating in a state in which no inertial force is exerted thereto. Therefore, in the case where a trouble occurs when the rotation time t becomes $t_1$, an ideal time at which the discharge exposure finishes is $t_1+t_a$ (see the First Embodiment). This $t_1+t_a$ is set as the exposure time (exposure condition) used for control of the exposing device 13 by the CPU 21. Note that this $t_1+t_a$ corresponds to the time $t_2$ in FIG. 9(*b*) at which inertial rotation of the photosensitive drum 11 stops. Besides, in FIG. 10(*a*), the inertial rotation time $t_b$ of the photosensitive drum 11 is assumed to be equal to the predetermined time $t_a$ ($t_b=t_a$).

On the other hand, FIG. 10(*b*) shows a case where discharge exposure corresponding to the charging time does not finish within the inertial rotation. Since the time when the photosensitive drum 11 stops is arbitrary, the following two cases, for example, are assumed in FIG. 10(*b*): a case ① where the photosensitive drum 11 stops rotating at a time when $t=t_{21}$ before the predetermined time $t_a$ has passed; and a case ② where the photosensitive drum 11 stops rotating at a time when $t=t_{22}$ after the predetermined time $t_a$ has passed.

In the foregoing case ①, the relationship shown in FIG. 10(*b*) is identical to that shown in FIG. 10(*a*) while the rotation time t is in a range of t=0 to $t=t_1$. But a period of time after the occurrence of a trouble while the rotation time t is in a range of $t=t_1$ to $t=t_{21}$ is a period of time while the charger 12 stops charging (OFF) due to the trouble, the discharge exposure time while the exposing device 13 carries out discharge exposure, and the inertial rotation time $t_b$ while the photosensitive drum 11 makes inertial rotation in the decelerating rotation state. Furthermore, after the rotation time t becomes $t_{21}$, since the inertial rotation of the photosensitive drum 11 stops, the discharge exposure by the exposing device 13 also stops.

As described above, the period of time within which the ideal discharge exposure is completed is $t_1+t_a$, but the period of time while the photosensitive drum 11 is actually discharged by exposure is $t_b=t_{21}-t_1$. Thus, the actual exposure time is $(t_1+t_a)-t_{21}$ shorter than the ideal exposure time. Therefore, the discharge exposure is again carried out upon the restarting of the apparatus for $(t_1+t_a)-t_{21}$ to compensate the shortage. This ensures complete discharge of the charge remaining region of the photosensitive drum 11.

The case ② is similar to that of the foregoing method ①. To be more specific, the relationship shown in FIG. 10(*b*) is identical to that shown in FIG. 10(*a*) while the rotation time t is in a range of t=0 to $t=t_1$. But a period of time after the occurrence of a trouble while the rotation time t is in a range of $t=t_1$ to $t=t_{22}$ is a period of time while the charger 12 stops charging (OFF) due to the trouble, the discharge exposure time while the exposing device 13 carries out discharge exposure, and the inertial rotation time $t_b$ while the photosensitive drum 11 makes inertial rotation in the decelerating rotation state. Furthermore, after the rotation time t becomes $t_{22}$, the inertial rotation of the photosensitive drum 11 stops, thereby causing the discharge exposure by the exposing device 13 to stop as well.

As described above, the period of time within which the ideal discharge exposure is completed is $t_1+t_a$, but the period of time while the photosensitive drum 11 is actually discharged by exposure is $t_b=t_{22}-t_1$. Therefore, the discharge exposure is again carried out upon the restarting of the apparatus for $(t_1+t_a)-t_{22}$ to compensate the shortage. This ensures complete discharge of the charge remaining region of the photosensitive drum 11.

Thus, according to the foregoing first method, the exposure time (exposure condition) is set based on the charging time and the predetermined time $t_a$ (predetermined condition), and the inertial rotation time $t_b$ (inertial rotation state) is compared with the exposure time. In so doing, the rotation state of the charge remaining region of the photosensitive drum 11 can be directly observed. Here, in the case where the exposure time is not longer than the inertial rotation time $t_b$, discharge exposure is continued during the inertial rotation of the photosensitive drum 11, whereas, in the case where the exposure time is longer than the inertial rotation time $t_b$, the discharge exposure is once stopped when the inertial rotation of the photosensitive drum 11 ends, and then, resumed upon restarting after the trouble is corrected. This enables discharge following changes in the state of the photosensitive drum 11, thereby ensuring not insufficient and not excessive, suitable and effective discharge of the charge remaining region on the surface of the photosensitive drum 11.

On the other hand, the other method is a method (second method) in which only the inertial rotation time $t_b$ until the photosensitive drum 11 completely stops is observed. By this method, the inertial rotation time $t_b$ obtained and the foregoing predetermined time $t_a$ are compared, and discharge exposure is carried out based on the comparison result. To use this method, an image forming apparatus is required to include inertial rotation time observing means for observing inertial rotation time $t_b$ as the detecting means 25.

Figure 11:
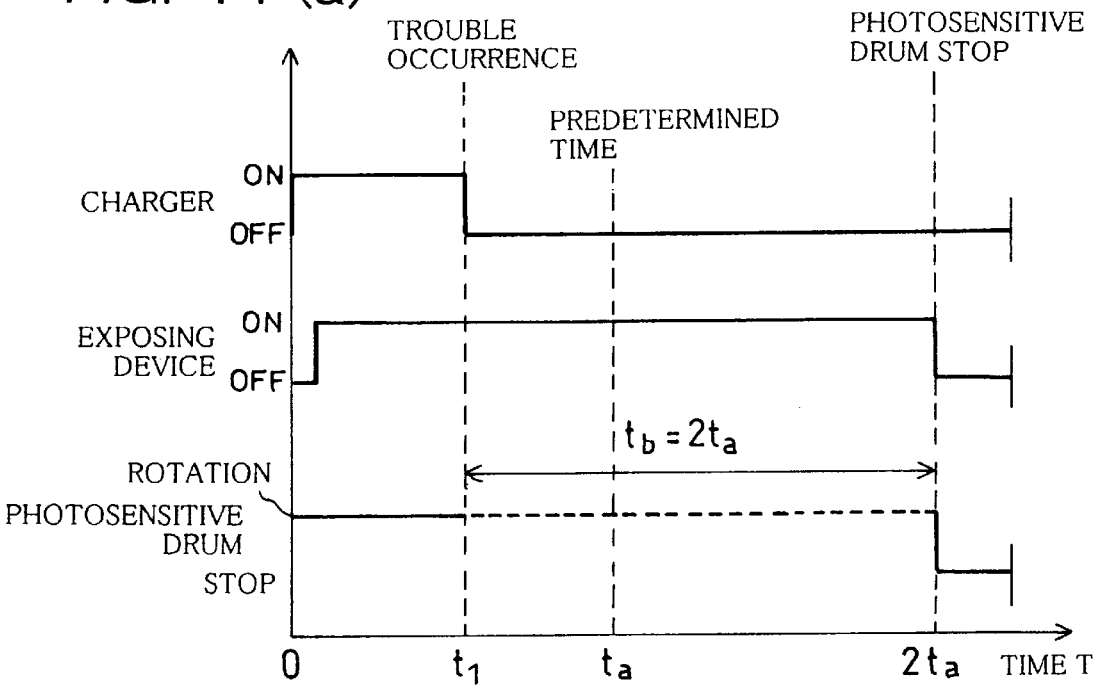
FIG. 11(*a*) is a timing chart showing another example of operations of a charger, an exposing device, and the photosensitive drum in the case where the discharge exposure finishes during an inertial rotation of the photosensitive drum shown in FIG. 2.
Figure 11:
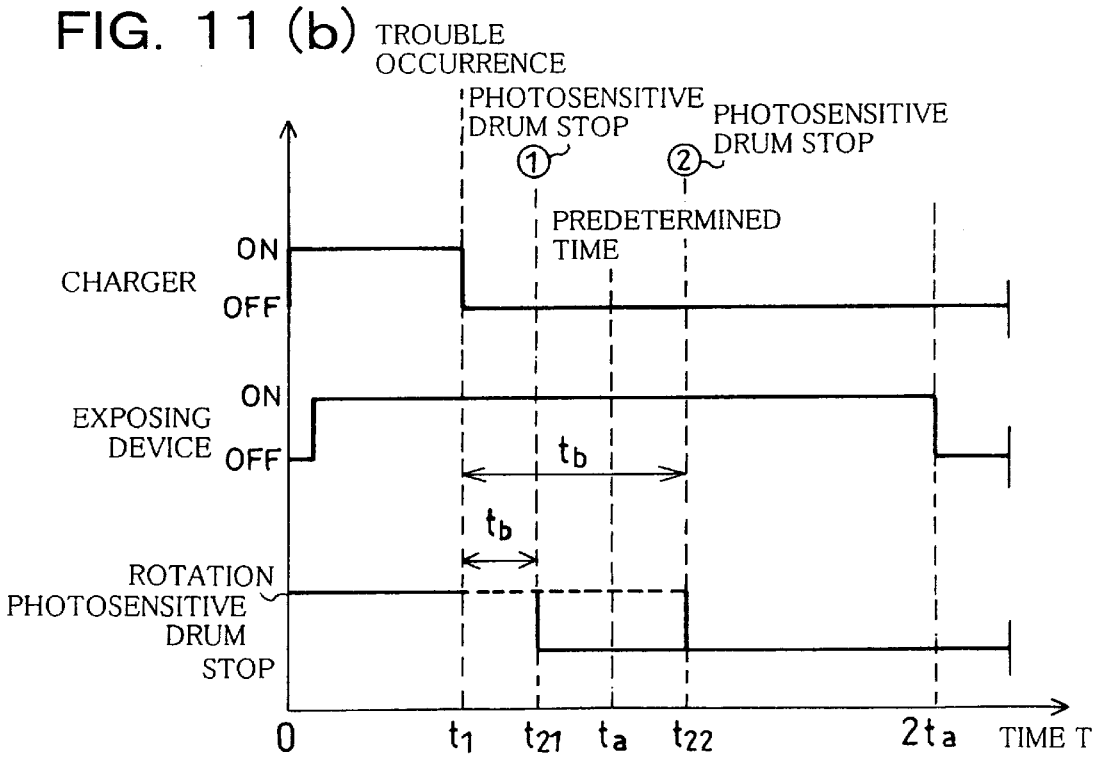

The following description will explain relationship of the rotation of the photosensitive drum 11 with the charging by the charger 12 and the exposure by the exposing means 13 (normal exposure, discharge exposure) in the control of the discharge exposure in accordance with the foregoing second method, while referring to FIGS. 11(*a*) and 11(*b*).

FIG. 11(*a*) shows an ideal case in which the discharge exposure can finish within the inertial rotation time $t_b$. Let the time at which the charging by the charger 12 starts and a time at which a trouble occurs be a time satisfying t=0, and a time $t_1$, respectively. Then, a period of time (predetermined time) during which the photosensitive drum 11 in the steady rotation state rotates from the charging position P to the exposure position Q be $t_a=t_1-t_0$.

In other words, a period of time during which the rotation time t varies from t=0 to $t_1$ is a charging time while the charger 12 charges the photosensitive drum 11, and a normal exposure time while the exposing device 13 carries out normal exposure, as well as a driving time while the photosensitive drum 11 rotates in the steady rotation state. Then, a period of time after the occurrence of a trouble while the rotation time t is in a range of from $t=t_1$ to $t=2t_a$ is a period of time while the charger 12 stops charging (OFF) due to the trouble, the discharge exposure time while the exposing device 13 carries out discharge exposure, and the inertial rotation time $t_b$ while the photosensitive drum 11 makes inertial rotation in the decelerating rotation state.

Here, the predetermined time $t_a$ is an ideal time required for the photosensitive drum 11 to stop rotating in a state in which no inertial force is exerted thereto. In the control according to the above-described first method, the charging time is measured by the charging time measuring means 12*e*, and an exposure condition derived from the charging time and the predetermined time $t_a$ as well as the inertial rotation time $t_b$ is used in the control, but the present control by the second method observes and uses only the foregoing inertial rotation time $t_b$.

In the case shown in FIG. 10(*a*), the charging time is obvious (time since when t=0 until when a trouble occurs, that is, $t=t_1$). Accordingly, an ideal time in which discharge exposure is completed is set by adding the predetermined time $t_a$ (time necessary for discharge exposure) to the charging time. On the other hand, in the case shown in FIG. 11(*a*), the charging time is not measured. Therefore, an ideal time in which discharge exposure is completed in the case of trouble occurrence is set by further adding the predetermined time $t_a$ (time necessary for discharge exposure) to the predetermined time $t_a$ as the maximum charging time. Consequently, the ideal time is set to $ta+t_a=2t_a$. This $2t_a$ is set as the exposure time (exposure condition) used in the control of the exposing device 13 by the CPU 21.

On the other hand, FIG. 11(*b*) shows a case where discharge exposure corresponding to the charging time is not completed during the inertial rotation. Since the time when the photosensitive drum 11 stops is arbitrary, the following two cases, for example, are assumed in FIG. 11(*b*), like in FIG. 10(*b*): a case ① where the photosensitive drum 11 stops rotating at a time when $t=t_{21}$before the predetermined time $t_a$ has passed; and a case ② where the photosensitive drum 11 stops rotating at a time when $t=t_{22}$ after the predetermined time $t_a$ has passed.

In the foregoing case ①, the relationship shown in FIG. 11(*b*) is identical to that shown in FIG. 11(*a*) while the rotation time t is in a range of t=0 to $t=t_1$. But a period of time after the occurrence of a trouble, while the rotation time t is in a range of $t=t_1$ to $t=t_{21}$, is a period of time while the charger 12 stops charging (OFF) due to the trouble, the discharge exposure time while the exposing device 13 carries out discharge exposure, and the inertial rotation time $t_b$ while the photosensitive drum 11 makes inertial rotation in the decelerating rotation state. Furthermore, after the rotation time t becomes $t_{21}$, the inertial rotation of the photosensitive drum 11 stops, thereby causing the discharge exposure by the exposing device 13 to stop as well.

As described above, the period of time within which the ideal discharge exposure is completed (exposure time) is $2t_a$, but the period of time while the photosensitive drum 11 is actually discharged by exposure is $t_b=t_{21}-t_1$. Thus, the actual exposure time is $2t_a-t_{21}$ shorter than the ideal exposure time. Therefore, the discharge exposure is again carried out upon the restarting of the apparatus for $2t_a-t_{21}$ to compensate the shortage. This ensures complete discharge of the charge remaining region of the photosensitive drum 11.

The case ② is similar to that of the foregoing method ①. To be more specific, the relationship shown in FIG. 11(*b*) is identical to that shown in FIG. 11(*a*) while the rotation time t is in a range of t=0 to $t=t_1$. But a period of time after the occurrence of a trouble, while the rotation time t is in a range of $t=t_1$ to $t=t_{22}$, is a period of time while the charger 12 stops charging (OFF) due to the trouble, the discharge exposure time while the exposing device 13 carries out discharge exposure, and the inertial rotation time $t_b$ while the photosensitive drum 11 makes inertial rotation in the decelerating rotation state. Furthermore, after the rotation time t becomes $t_{22}$, the inertial rotation of the photosensitive drum 11 stops, thereby causing the discharge exposure by the exposing device 13 to also stop.

As described above, the period of time within which the ideal discharge exposure is completed is $2t_a$, but the period of time while the photosensitive drum 11 is actually discharged by exposure is $t_b=t_{22}-t_1$. Therefore, the discharge exposure is again carried out upon the restarting of the apparatus for $2t_a-t_{22}$ to compensate the shortage. This ensures complete discharge of the charge remaining region of the photosensitive drum 11.

Thus, according to the above-described second method, the exposure time (exposure condition) is set based on the predetermined time $t_a$ (predetermined condition) and the inertial rotation time $t_b$ (inertial rotation state) is compared with the exposure time. In so doing, the rotation state of the charge remaining region of the photosensitive drum 11 can be directly observed. In other words, the second method can be regarded as a method in which the predetermined time $t_b$ and the inertial rotation time are directly compared.

Therefore, in the case where the predetermined time $t_a$ (exposure time) is not longer than the inertial rotation time $t_b$, discharge exposure is continued during the inertial rotation of the photosensitive drum 11, whereas, in the case where the predetermined time $t_a$ (exposure time) is longer than the inertial rotation time $t_b$, the discharge exposure is once stopped when the inertial rotation of the photosensitive drum 11 ends, and then, after the restarting, the discharge exposure is completed within a period of time since the front end of the charge remaining region passes the charging position until the rear end of the charge remaining region passes the exposure position. This enables discharge following changes in the state of the photosensitive drum 11, thereby ensuring not insufficient and not excessive, suitable and effective discharge of the charge remaining region on the surface of the photosensitive drum 11.

Incidentally, to identify the charge remaining region based on the foregoing inertial rotation time $t_b$ obtained by observation, the following scheme is applicable as well: the inertial rotation time $t_b$ is previously measured and stored in a table form in recording means such as a ROM that is incorporated in, or connected with, control means such as the CPU 21, and the inertial rotation time $t_b$ actually obtained by observation is compared with the table.

Furthermore, the detection means 25 as the inertial rotation time observing means may be arranged so as to be capable of detecting the length of the predetermined time $t_a$. By so doing, the predetermined time $t_a$ is accurately and surely grasped, thereby making calculation of the exposure time and grasping the charge remaining region more accurate.

Furthermore, the following method is applicable as a concrete control method in the case where the foregoing rotation angle θ is used as a parameter (rotation condition). Note that the control method using the rotation angle θ is not limited to this.

As explained in the description of the foregoing first embodiment, timings at which troubles occur are classified into the following two patterns: the first trouble occurrence pattern in which a trouble occurs when the front end S of the charged region is passing in an area between the charging position P to the exposure position Q, as shown in FIG. 4; and the second trouble occurrence pattern in which a trouble occurs when the front end S of the charged region has passed the exposure position Q, as shown in FIGS. 5(*a*) and 5(*b*).

Here, in the case where a rotation angle $\theta_2$ as an angle of advance of the photosensitive drum 11 during the inertial rotation time $t_b$ is not smaller than the rotation angle $\theta_1$ of the photosensitive drum 11 in the steady rotation state during the predetermined time $t_a$ ($\theta_1 \leqq \theta_2$), the discharge exposure finishes during the inertial rotation time $t_b$. On the other hand, in the case where the rotation angle $\theta_2$ is smaller than the rotation angle $\theta_1$ ($\theta_1 > \theta_2$), the discharge exposure does not finish during the inertial rotation time $t_b$.

Therefore, from the charging time measure by the charging time measuring means 12*e*, for example, it is judged which the trouble occurrence timing is, either the foregoing first trouble occurrence pattern or the foregoing second trouble occurrence pattern. In the case where it is judged to be the first trouble occurrence pattern, the charge remaining region is smaller than the region pq. Accordingly, an angle through which the photosensitive drum rotates during discharge exposure (hereinafter referred to as exposure angle) (alternatively, a time for discharge exposure) is indiscriminately set to an angle (or time) through which the surface of the photosensitive drum 11 moves from the charging position P to the exposure position Q.

Then, from the result of measurement of a rotation angle $\theta_2$ by the rotation angle measuring means 25*b*, it is judged whether or not the discharge exposure is completed within the inertial rotation time (in other words, whether or not the discharge exposure is completed while the photosensitive drum 11 rotates through a rotation angle corresponding to the inertial rotation time $t_b$ (i.e., an inertial rotation angle)). In the case where it is completed, the apparatus is restarted, whereas in the case where it is not completed, discharge exposure is applied to the rest upon restarting.

On the other hand, in the case where the trouble occurrence timing is judged to be the second trouble occurrence pattern from the foregoing charging time, the charge remaining region agree with the region pq, and hence, cannot be completed within the inertial rotation time $t_b$. In other words, the discharge of the entire charge remaining region cannot be completed during the rotation of the photosensitive drum 11 through the inertial rotation angle. Therefore, the discharge exposure is applied by setting the exposure angle (or time) to an angle (or time) corresponding to a rotation from the charging position P to the exposure position Q, and thereafter, the rest is discharged upon restarting.

Incidentally, the foregoing judgment regarding the first and second trouble occurrence patterns is advantageously applicable to the control method in which the rotation time t is used as a parameter. The application method is identical to that of the foregoing case in which the rotation angle θ is used as such.

Since the rotation time t and the rotation angle θ are parameters used as the rotation condition of the photosensitive drum 11 and as the inertial rotation state of the photosensitive drum 11 making inertial rotation, they are detected by the detecting means 25 shown in FIG. 2 (the rotation time t is measured by the time measuring means 25*a*, while the rotation angle θ is measured by the rotation angle measuring means 25*b*). Based on the detection result, the CPU 21 controls the exposing operation by the exposing device 13. The following description will explain the control method using the rotation time t or the rotation angle θ, while referring to flowcharts.

Figure 12:
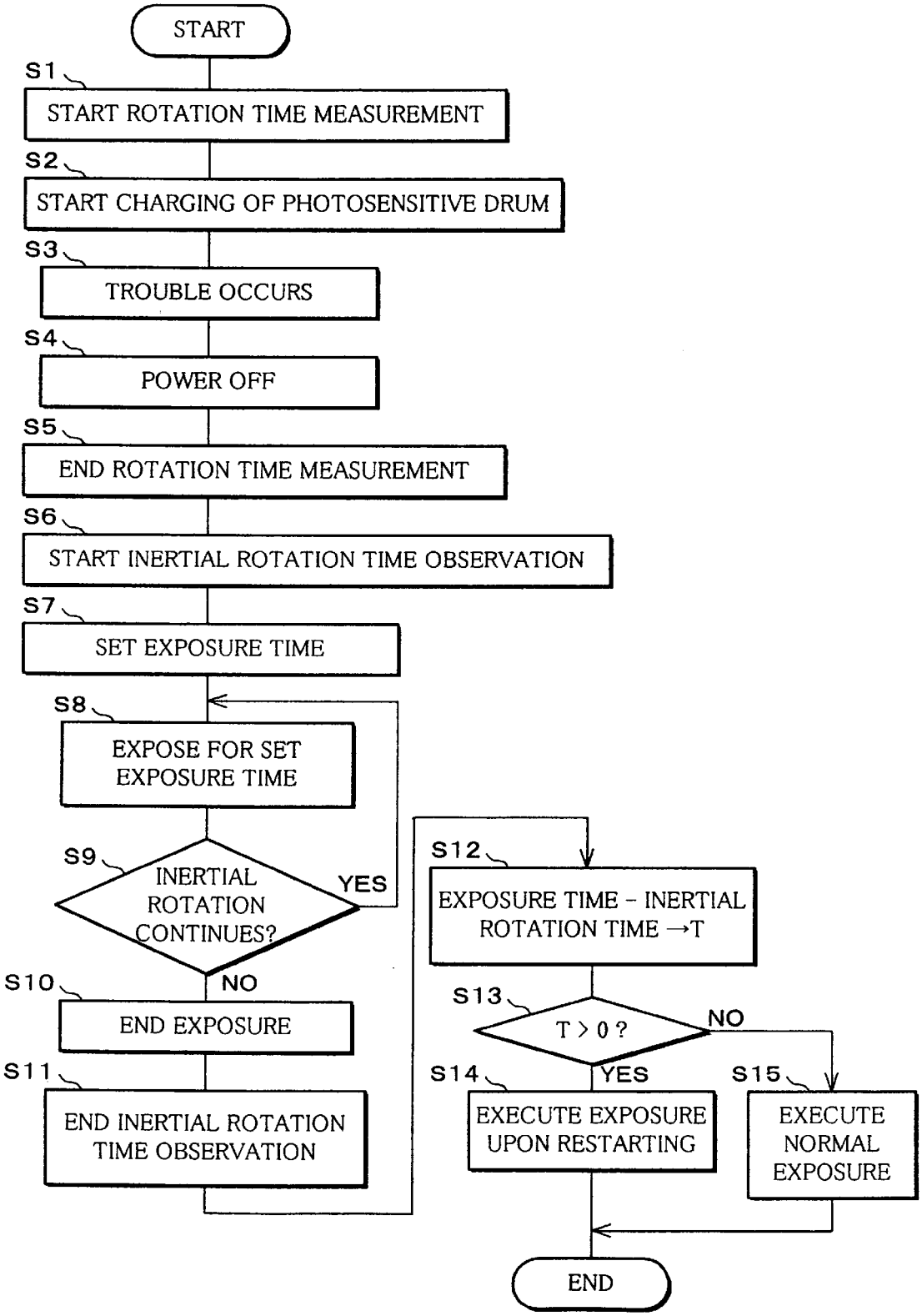
FIG. 12 is a flowchart showing an example of a scheme for controlling discharge exposure shown in FIG. 1 by checking a time of an inertial rotation of the photosensitive drum.

First, the control method using the rotation time t as a parameter has 15 steps, as shown in the flowchart of FIG. 12. To begin with, the rotation time t of the photosensitive drum 11 is measured by the detecting means 25 (step 1; hereinafter "step" is abbreviated as "S"). Next, the charging of the photosensitive drum 11 by the charger 12 is started (S2). Here, when occurrence of a trouble to the image forming apparatus is detected (S3), the apparatus is powered off (S4). Immediately measurement of the rotation time t stops (S5), and at the same time, observation of the inertial rotation time $t_b$ by the detecting means 25 is started (S6). With the inertial rotation of the photosensitive drum 11, the discharge exposure time is set based on a period of time in which the entire charged region pq (see FIG. 4) in the steady rotation state is discharged (the aforementioned predetermined time $t_a$) (S7). Discharge exposure is carried out during the discharge exposure time (S8).

Next, based on the detection result (observation result) of the detecting means 25, the CPU 21 judges whether or not the inertial rotation of the photosensitive drum 11 continues (S9). In the case where the inertial rotation continues, the discharge exposure is continued (return to S8), whereas, in the case where the inertial rotation has stopped, the discharge exposure is stopped (S10). Upon the stop of the discharge exposure, the observation of the inertial rotation time $t_b$ stops (S11). Here, the CPU 21 compares the set discharge exposure time (set at S7) with the inertial rotation time $t_b$ (S12), and outputs a comparison result T. Then, whether or not the comparison result T is greater than 0 is judged (S13).

In the case where the comparison result T is greater than 0, this means that the discharge exposure time is longer than the inertial rotation time $t_b$, thereby making the CPU 21 to judge that the photosensitive drum 11 is insufficiently discharged. Consequently, the exposing device 13 is caused to carry out discharge exposure upon the restarting of the apparatus, to discharge the surface of the photosensitive drum 11 (S14). On the other hand, in the case where the comparison result T is not greater than 0, the CPU 21 judges that discharge exposure is completed within the inertial rotation time $t_b$. Consequently, the restarting of the apparatus is normally carried out (S15).

In the discharge exposure as described above, it is desirable that the comparison result T is not greater than 0, that is, the discharge exposure is completed within the inertial rotation time $t_b$ of the photosensitive drum 11, as at S15. Otherwise, in the case where the discharge exposure is not completed within the inertial rotation time $t_b$, discharge exposure is carried out again upon the restarting of the apparatus, as at S14, so that the photosensitive drum 11 is completely discharged. In such control, to obtain the comparison result T, either the foregoing first or second methods is applied.

Figure 13:
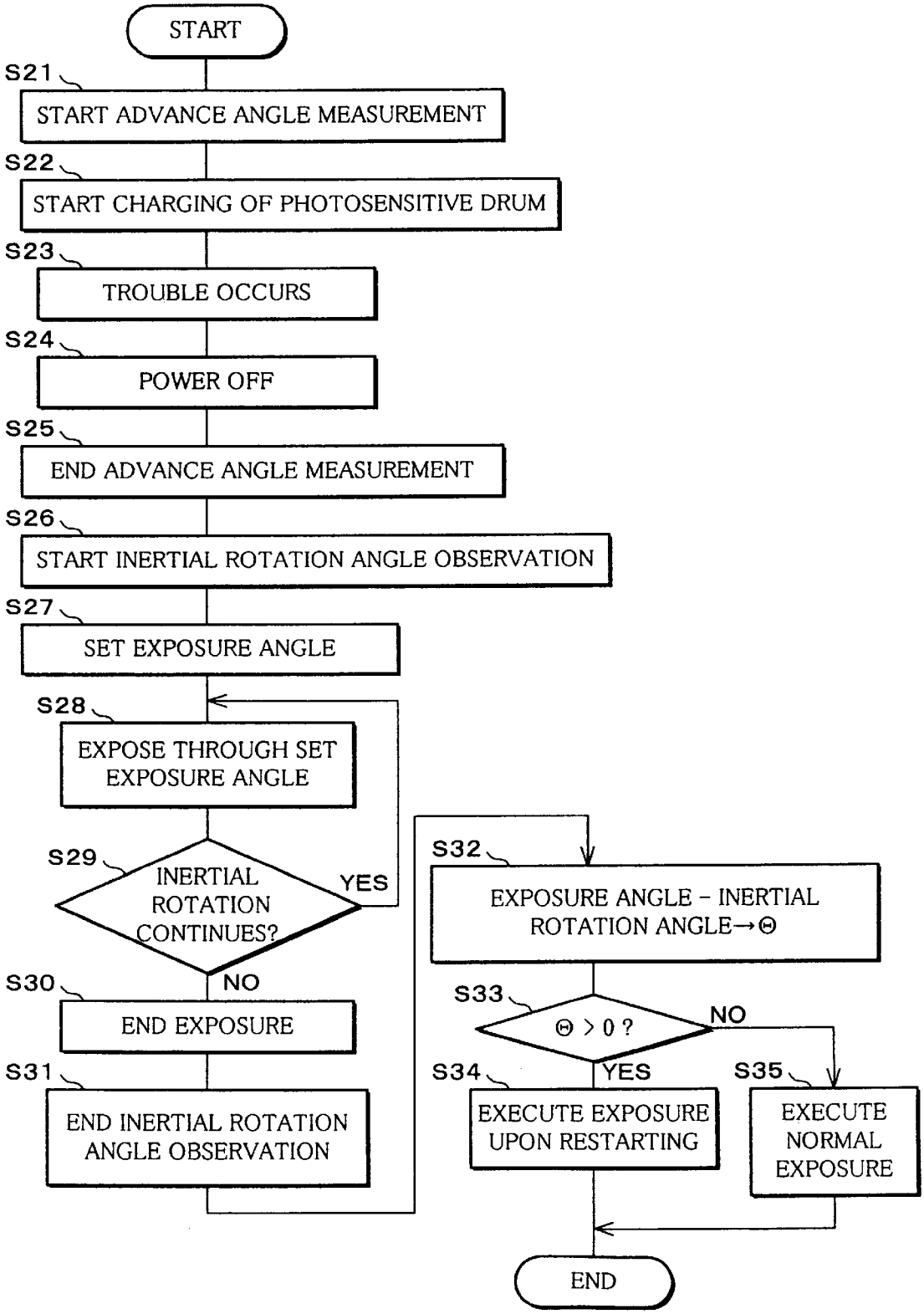
FIG. 13 is a flowchart showing an example of a scheme for controlling discharge exposure shown in FIG. 1 by checking an angle of an inertial rotation of the photosensitive drum.
Figure 14:
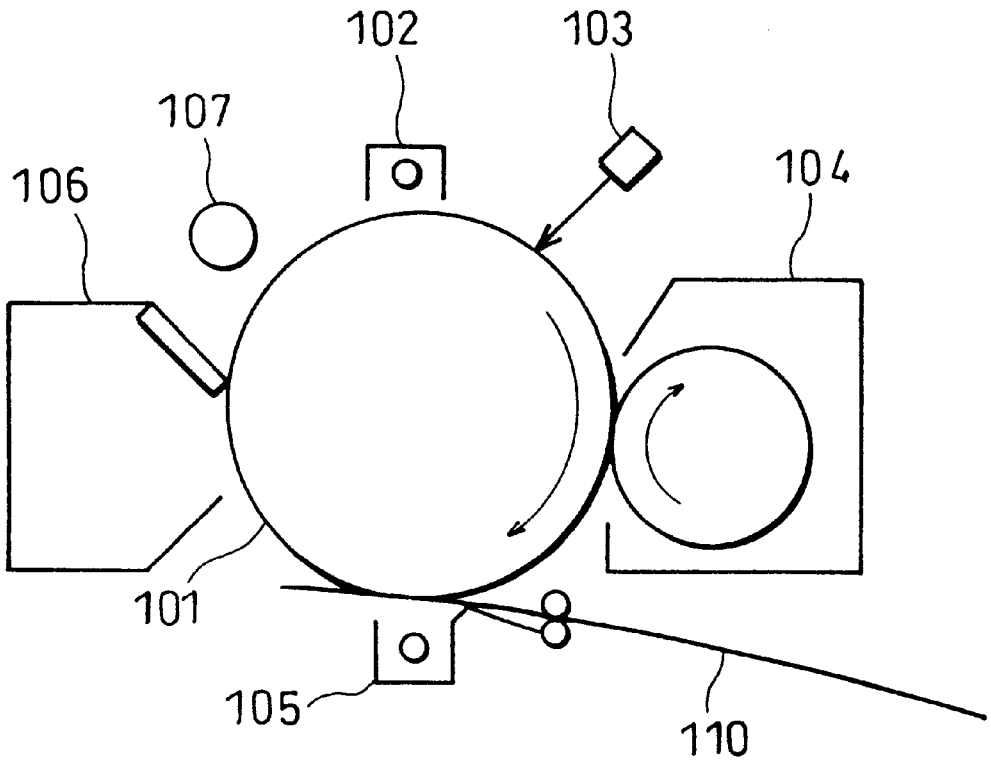
FIG. 14 is a schematic view illustrating an arrangement of a conventional image forming apparatus.

The control method using the rotation angle θ as the foregoing parameter is basically identical to the control using the rotation time t, and is carried out through 15 steps of S21 through S35 in the flowchart of FIG. 13.

To begin with, measurement of the rotation angle θ of the photosensitive drum 11 by the detecting means 25 is started (S21). Next, the charging of the photosensitive drum 11 by the charger 12 is started (S22). Here, when occurrence of a trouble to the image forming apparatus is detected (S23), the apparatus is powered off (S24). Immediately measurement of the rotation angle θ stops (S25), and at the same time, observation of the inertial rotation angle $\theta_0$ by the rotation angle measuring means 25*b* (detecting means 25) is started (S26). With the inertial rotation of the photosensitive drum 11, the exposure angle is set according to an angle through which the entire charged region pq (see FIG. 4) in the steady rotation state is discharged (S27). Discharge exposure is carried out through this angle (S28). Note that the exposure angle is set by the aforementioned control method.

Next, based on the detection result of the detecting means 25, the CPU 21 judges whether or not the inertial rotation of the photosensitive drum 11 continues (S29). In the case where the inertial rotation continues, the discharge exposure is continued (return to S28), whereas, in the case where the inertial rotation has stopped, the discharge exposure is stopped (S30). Upon the stop of the discharge exposure, the observation of the inertial rotation angle stops (S31). Here, the CPU 21 compares the set exposure angle (set at S27) with the inertial rotation angle of the photosensitive drum 11 (S32), and outputs a comparison result θ. Then, whether or not the comparison result θ is greater than 0 is judged (S33).

In the case where the comparison result θ is greater than 0, this means that the exposure angle is greater than the inertial rotation angle, thereby making the CPU 21 to judge that the photosensitive drum 11 is insufficiently discharged. Consequently, the exposing device 13 is caused to carry out discharge exposure upon the restarting of the apparatus, to discharge the surface of the photosensitive drum 11 (S34). On the other hand, in the case where the comparison result θ is not greater than 0, the CPU 21 judges that discharge exposure is completed at the exposure position Q, within the rotation of the photosensitive drum 11 corresponding to the inertial rotation angle. Consequently, the restarting of the apparatus is normally carried out (S35).

As described above, the image forming apparatus in accordance with the present invention is arranged so that, ensuing to stop of operation of the image forming apparatus upon occurrence of a trouble, (i) the exposing device 13 discharges by exposure the surface of the photosensitive drum 11 during an inertial rotation time $t_b$ (or through a rotation angle of the photosensitive drum 11 during the inertial rotation time $t_b$), and (ii) the discharge exposure is carried out again upon restarting after correction of the trouble in the case where the discharge is not completed during the foregoing inertial rotation time $t_b$ (or through a rotation angle of the photosensitive drum 11 during the inertial rotation time $t_b$), so that remaining charges are removed.

Here, in the case where the CPU 21 judges that the set exposure condition is a condition such that the discharge can be completed within the inertial rotation time $t_b$ (or through an angle of advance of the photosensitive drum 11 during the inertial rotation time $t_b$), the CPU 21 causes the exposure to be continuously carried out during the inertial rotation time $t_b$. On the other hand, in the case where the CPU 21 judges that the set exposure condition is a condition such that the discharge is to be carried out for a longer period of time than the inertial rotation time $t_b$ (or for a period of time the photosensitive drum 11 rotates through a greater angle than the angle the photosensitive drum 11 rotates during the inertial rotation time $t_b$), the CPU 21 causes the exposure to stop upon the stop of the inertial rotation while to resume the exposure upon start of rotation of the photosensitive drum 11 upon the restarting of the apparatus after the trouble is corrected.

Therefore, charges remaining on the surface of the photosensitive drum 11 due to the charging immediately before the trouble occurrence are surely removed therefrom, resulting in sure prevention of adhesion of toner or carrier to the surface of the photosensitive drum 11. Consequently, excessive accumulation of charges on the photosensitive drum 11 and damage to the photosensitive drum 11 are prevented, and safety of the apparatus is enhanced.

Furthermore, it is possible to immediately shift to the next image forming operation upon the restarting of the apparatus after the trouble is corrected, since the photosensitive drum 11 is discharged during its inertial rotation. This makes it unnecessary to prepare an extra period of time for the discharge after correction of the trouble, thereby ensuring remarkable improvement of the operational efficiency of the apparatus.

In the case were the discharge exposure is not completed within the foregoing inertial rotation time $t_b$ and is also executed upon restarting of the apparatus, the observation of the inertial rotation state or the setting of the exposure condition are extremely preferably executed by using the rotation time t or the rotation angle θ of the photosensitive drum 11 as a parameter. For example, with use of the rotation time t as a parameter, the discharge is continued during the inertial rotation time $t_b$ in the case where the discharge exposure time (exposure condition) is not shorter than the inertial rotation time $t_b$ (inertial rotation state), whereas the discharge is continued during the inertial rotation time $t_b$ and is again carried out upon the restarting of the apparatus in the case where the discharge exposure time is shorter than the inertial rotation time $t_b$.

Incidentally, in the image forming apparatus of the present invention, components or members for exerting a braking effect to the photosensitive drum 11 are preferably not provided, so that a sufficient inertial rotation time $t_b$ of the photosensitive drum 11 is obtained. For example, the aforementioned cleaning device 16 preferably has a bladeless structure, or the apparatus preferably has no cleaning device 16.

Furthermore, considering the inertial rotation time $t_b$ due to the fly-wheel effect of the photosensitive drum 11, a large-size high-speed device is preferable, since a longer inertial rotation time $t_b$ can be obtained by a large-size high-speed device than that obtained by a small-size low-speed device.

Furthermore, the photosensitive drum 11 is preferably arranged so as to be disengaged from a driving system and the like upon stop of a motor driving the photosensitive drum 11, by using a known electromagnetic clutch or the like. In this case, the photosensitive drum 11 can be made to rotate independently and completely freely. Consequently, a braking effect upon stop of a motor can be obviated.

A first image forming apparatus of the present invention includes (i) a photosensitive drum for holding an electrostatic latent image on its surface, the photosensitive drum being driven to rotate by a motor, (ii) charging means for charging the surface of the photosensitive drum so that the surface has a predetermined polarity and a predetermined potential, (iii) exposing means for forming an electrostatic latent image by exposing the charged surface of the photosensitive drum, and (iv) developing means for developing the electrostatic latent image, and the apparatus is characterized in that, after an operation of the apparatus is stopped due to occurrence of a trouble, during an inertial rotation time in which the motor is stopped but the photosensitive drum rotates due to an inertial force, the exposing means exposes a charge remaining region on the surface of the photosensitive drum so that charges remaining therein are removed.

According to the foregoing arrangement, discharge is carried out by exposure by the exposing means during the inertial rotation time of the photosensitive drum. Therefore, remaining charges are surely removed without provision of an independent discharging means, thereby resulting in prevention of adhesion of toner and carrier to the surface of the photosensitive drum. Consequently, excessive accumulation of charges and damage to the photosensitive drum are surely avoided, and therefore, safety is enhanced.

Moreover, since the photosensitive drum is discharged during the inertial rotation time, it is possible to immediately shift to the next image forming operation upon restarting after a trouble is corrected. This makes it unnecessary to prepare an extra period of time for the discharge after correction of the trouble, thereby ensuring remarkable improvement of the operational efficiency of the apparatus.

A second image forming apparatus of the present invention is characterized in that in the case where the inertial rotation time ends before the entire charge remaining region is discharged, the exposing means again executes exposure for discharge when the photosensitive drum resumes rotating upon restarting of the image forming apparatus after the trouble is corrected.

According to the foregoing arrangement, in the case where the discharge is not completed during the inertial rotation time, discharge exposure is again carried out upon restarting of the apparatus after the trouble is corrected, so that remaining charges are removed. Therefore, remaining charges are more surely removed without provision of an independent discharging means, thereby resulting in prevention of adhesion of toner and carrier to the surface of the photosensitive drum. Besides, the operational efficiency of the apparatus is remarkably enhanced.

A third image forming apparatus of the present invention is the second image forming apparatus further characterized by further including (v) inertial rotation state observing means for observing an inertial rotation state of the photosensitive drum which rotates due to the inertial force, and (vi) control means for setting an exposure condition for discharge, based on a predetermined condition for a period of time since the photosensitive drum steadily rotating is charged until exposure ends, and for controlling the exposing operation by the exposing means by comparing the observation result of the inertial rotation state and the exposure condition.

According to the foregoing arrangement, a predetermined condition since the photosensitive drum in the steady rotation state is charged until the exposure ends and the inertial rotation state of the photosensitive drum upon occurrence of a trouble are used for setting the exposure condition.

Consequently, the exposure condition can be more precisely set. This ensures that in the arrangement of the second image forming apparatus in which the discharge is carried out upon the restarting of the apparatus in the case where the discharge exposure is not completed within the inertial rotation, the discharge upon the restarting is more surely carried out, so that remaining charges are completely removed.

A fourth image forming apparatus of the present invention is the third image forming apparatus further characterized by further including charging time measuring means for measuring a charging time since the charging of the photosensitive drum starts until an operation stops due to the occurrence of the trouble.

With the foregoing arrangement, the exposure condition can be more accurately set since the time of charging by the charging means is also used for setting the exposure time. This ensures that in the arrangement of the second image forming apparatus in which the discharge is carried out upon the restarting of the apparatus in the case where the discharge exposure is not completed within the inertial rotation, the discharge upon the restarting is more surely carried out, so that remaining charges are completely removed.

A fifth image forming apparatus of the present invention is either the third or fourth image forming apparatus further characterized in that at least one of a rotation time in which the photosensitive drum rotates and a rotation angle through which the photosensitive drum rotates is observed or set as the inertial rotation state and the exposure condition.

According to the foregoing arrangement, the rotation time or the rotation angle of the photosensitive drum is used as a parameter for numerically defining an actual inertial rotation state of the photosensitive drum or an actual exposure condition of the exposing means. Therefore, by distinguish the case where the discharge exposure can be completed during the inertial rotation time of the photosensitive drum and the case where the discharge exposure is not completed within the inertial rotation time, the discharge exposure by the exposing means can be surely controlled.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus, comprising:

a photosensitive drum for holding an electrostatic latent image on its surface, said photosensitive drum being driven to rotate by a motor;

charging means for charging the surface of said photosensitive drum so that the surface has a predetermined polarity and a predetermined potential;

exposing means for forming an electrostatic latent image by exposing the charged surface of the photosensitive drum; and developing means for developing the electrostatic latent image, wherein, after stop of the motor due to occurrence of a trouble, during an inertial rotation time in which said photosensitive drum rotates due to an inertial force, said exposing means executes discharge exposure with respect to a charge remaining region on the surface of said photosensitive drum.

2. The image forming apparatus as set forth in claim 1, wherein, in the case where the inertial rotation time ends before the entire charge remaining region is discharged, said exposing means again executes exposure for discharge when said photosensitive drum resumes rotating upon restarting of said image forming apparatus after the trouble is corrected.

3. The image forming apparatus as set forth in claim 2, wherein said exposing means suspends exposure since stop of the inertial rotation of said photosensitive drum until resumption of rotation of said photosensitive drum.

4. The image forming apparatus as set forth in claim 2, further comprising:

inertial rotation state observing means for observing an inertial rotation state of said photosensitive drum which rotates due to the inertial force; and control means for setting an exposure condition for discharge, based on a predetermined condition for a period of time since said photosensitive drum steadily rotating is charged until exposure ends, and for controlling the exposing operation by said exposing means by comparing the observation result of the inertial rotation state and said exposure condition.

5. The image forming apparatus as set forth in claim 4, wherein at least one of a rotation time in which said photosensitive drum rotates and a rotation angle through which said photosensitive drum rotates is observed or set as the inertial rotation state and the exposure condition.

6. The image forming apparatus as set forth in claim 5, wherein said inertial rotation state observing means includes time measuring means for measuring the inertial rotation time of said photosensitive drum and for outputting a result of the measurement to said control means.

7. The image forming apparatus as set forth in claim 5, wherein said inertial rotation state observing means includes rotation angle measuring means for measuring the rotation angle through which said photosensitive drum rotates during the inertial rotation time and for outputting a result of the measurement to said control means.

8. The image forming apparatus as set forth in claim 4, further comprising:

charging time measuring means for measuring a charging time since the charging of said photosensitive drum starts until an operation stops following to the occurrence of the trouble.

9. The image forming apparatus as set forth in claim 8, wherein at least one of a rotation time in which said photosensitive drum rotates and a rotation angle through which said photosensitive drum rotates is observed or set as the inertial rotation state and the exposure condition.

10. The image forming apparatus as set forth in claim 9, wherein said inertial rotation state observing means includes time measuring means for measuring the inertial rotation time of said photosensitive drum and for outputting a result of the measurement to said control means.

11. The image forming apparatus as set forth in claim 10, wherein said inertial rotation state observing means includes rotation angle measuring means for measuring the rotation angle through which said photosensitive drum rotates during the inertial rotation time and for outputting a result of the measurement to said control means.

* * * * *